US010527997B2

(12) United States Patent
Hikichi

(10) Patent No.: US 10,527,997 B2
(45) Date of Patent: Jan. 7, 2020

(54) IMAGE FORMING APPARATUS AND METHOD FOR CONTROLLING SAME, AND STORAGE MEDIUM

(71) Applicant: CANON KABUSHIKI KAISHA, Tokyo (JP)

(72) Inventor: Atsushi Hikichi, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/050,267

(22) Filed: Jul. 31, 2018

(65) Prior Publication Data

US 2018/0335743 A1 Nov. 22, 2018

Related U.S. Application Data

(63) Continuation of application No. 15/260,776, filed on Sep. 9, 2016, now Pat. No. 10,067,455, which is a (Continued)

(30) Foreign Application Priority Data

May 7, 2014 (JP) ..... 2014-096220

(51) Int. Cl.
*G03G 15/00* (2006.01)
*B65H 37/04* (2006.01)
(Continued)

(52) U.S. Cl.
CPC ..... *G03G 15/6541* (2013.01); *B42B 4/00* (2013.01); *B65H 37/04* (2013.01); *B65H 43/00* (2013.01);
(Continued)

(58) Field of Classification Search
CPC ..... G03G 15/6541; G03G 15/80; G03G 15/5004; G03G 15/6582
See application file for complete search history.

(56) References Cited

U.S. PATENT DOCUMENTS 4,917,366 A * 4/1990 Murakami ..... B42C 1/12 227/7
2005/0135830 A1 6/2005 Koyama
(Continued)

FOREIGN PATENT DOCUMENTS

CN 1731813 A 2/2006
CN 103517010 A 1/2014
(Continued)

OTHER PUBLICATIONS

European Search Report issued in corresponding Patent Application No. 15001219.3 dated Sep. 2, 2015.
(Continued)

*Primary Examiner* — G. M. A Hyder
(74) *Attorney, Agent, or Firm* — Carter, DeLuca & Farrell LLP

(57) ABSTRACT

In an image forming apparatus to which a finisher is connected, a power source control unit shifts the image forming apparatus to a power saving state. The image forming apparatus is inhibited from being shifted to the power saving state when it is detected that a sheet for which a binding process is to be performed is set in the finisher. The image forming apparatus may be permitted to be shifted to the power saving state when it is not detected that the sheet is set in the finisher.

22 Claims, 16 Drawing Sheets

Related U.S. Application Data continuation of application No. 14/695,523, filed on Apr. 24, 2015, now Pat. No. 9,454,121.

(51) Int. Cl.
*B65H 43/00* (2006.01)
*B42B 4/00* (2006.01)

(52) U.S. Cl.
CPC ..... *G03G 15/5004* (2013.01); *G03G 15/6582* (2013.01); *G03G 15/80* (2013.01); *G03G 2215/00392* (2013.01)

(56) References Cited

U.S. PATENT DOCUMENTS

| | | | | |
|---|---|---|---|---|
| 2007/0047998 | A1 | 3/2007 | Watanabe et al. | |
| 2007/0279646 | A1 | 12/2007 | Sugimoto et al. | |
| 2010/0166448 | A1 | 7/2010 | Mikami | |
| 2012/0128385 | A1 | 5/2012 | Song et al. | |
| 2014/0160506 | A1* | 6/2014 | Miyajima | G06K 15/403 358/1.13 |
| 2014/0239571 | A1 | 8/2014 | Kakutani et al. | |
| 2014/0334901 | A1* | 11/2014 | Sato | B42B 9/00 412/12 |
| 2014/0369731 | A1* | 12/2014 | Yasukawa | G03G 15/6582 399/407 |
| 2015/0145200 | A1 | 5/2015 | Hikichi | |

FOREIGN PATENT DOCUMENTS

| | | | |
|---|---|---|---|
| EP | 2680561 | A1 | 1/2014 |
| JP | 2003015479 | A | 1/2003 |
| JP | 2005107322 | A | 4/2005 |
| JP | 2005246870 | A | 9/2005 |
| JP | 2008209824 | A | 9/2008 |
| JP | 2012179895 | A | 9/2012 |

OTHER PUBLICATIONS

Chinese Office Action for Patent Application No. 201510223747.8 dated Nov. 1, 2017.
Korean Office Action for Patent Application No. 10-2015-0062878 dated Jan. 2, 2018.
Japanese Office Action for Patent Application No. 2014096220 dated Mar. 2, 2018.

* cited by examiner

IMAGE FORMING APPARATUS AND METHOD FOR CONTROLLING SAME, AND STORAGE MEDIUM

BACKGROUND OF THE INVENTION

Field of the Invention

The present invention relates to image forming apparatuses and methods for controlling image forming apparatuses, and a storage medium.

Description of the Related Art

Improvements to the power saving function allow an image forming apparatus to have, for example, a plurality of power saving functions as follows. An automatic sleep timer is a function of putting an image forming apparatus into a sleep state when the user has not used the image forming apparatus for a predetermined continuous period of time. An automatic sleep time is a function of automatically putting an image forming apparatus into a sleep state at a time designated by the user. An automatic shut-down timer is a function of performing a process of shutting down an image forming apparatus and thereby turning the image forming apparatus off when the user has not used the image forming apparatus for a predetermined continuous period of time. An automatic shut-down time is a function of performing a process of shutting down an image forming apparatus and thereby turning the image forming apparatus off at a time designated by the user.

An image forming apparatus having a finisher with a stapler can staple printed sheets. The finisher with a stapler provides a function of stapling printed sheets, a manual stapling function of stapling a bundle of sheets which is put by the user into a sheet insertion slot, separately from the printing operation of the image forming apparatus, and the like.

Japanese Patent Laid-Open No. 2005-107322 describes a finisher apparatus having a stapling function which is switched between automatic stapling and manual stapling, using a mode switch.

In the above image forming apparatus having a manual stapling function, when the manual stapling function and the power saving function are simultaneously enabled, the image forming apparatus is likely to shift to a power saving state during manual stapling. For example, if the automatic sleep timer expires or the automatic sleep time comes while the user is manually stapling, the image forming apparatus goes to the power saving state, so that the manual stapling function is interrupted. Also, if the automatic shut-down timer expires or the automatic shut-down time comes while the user is manually stapling, the image forming apparatus performs a shut-down process to turn itself off. Also, in this case, the manual stapling function is interrupted.

In addition, in the case of an image forming apparatus connected to a finisher, if the image forming apparatus shifts to a sleep state or a shut-down state, the execution of a function performed by the finisher is interrupted. Also, in an image forming apparatus having such a configuration, even when the user desires to use the finisher alone, it is necessary to cause the image forming apparatus to return from the sleep mode, which is not convenient for the user.

SUMMARY OF THE INVENTION

In order to solve the above related-art problems, the present invention provides a technique of preventing the finisher from being interrupted by an image forming apparatus entering a power saving state.

According to one aspect of the present invention, there is provided an image forming apparatus to which a finisher is connected, comprising: a power source control unit configured to shift the image forming apparatus to a power saving state; and a control unit configured to inhibit the power source control unit from shifting the image forming apparatus to the power saving state when it is detected that a sheet for which a binding process is to be performed is set by a user in the finisher.

According to another aspect of the present invention, there is provided a method for controlling an image forming apparatus to which a finisher is connected, comprising: a power source control step of shifting the image forming apparatus to a power saving state; and a control step of inhibiting the image forming apparatus from being shifted to the power saving state when it is detected that a sheet for which a binding process is to be performed is set by a user in the finisher.

According to still another aspect of the present invention, there is provided a non-transitory computer-readables storage medium storing a computer program for causing a computer to execute steps of a method for controlling an image forming apparatus to which a finisher is connected, comprising: a power source control step of shifting the image forming apparatus to a power saving state; and a control step of inhibiting the image forming apparatus from being shifted to the power saving state when it is detected that a sheet for which a binding process is to be performed is set by a user in the finisher.

According to the present invention, when the finisher is being operated, the image forming apparatus is caused not to enter the power saving state, such as a sleep state, shut-down state, or the like, whereby a function of the finisher can be prevented from being interrupted by the image forming apparatus entering the power saving state.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

First Embodiment

Figure 1:
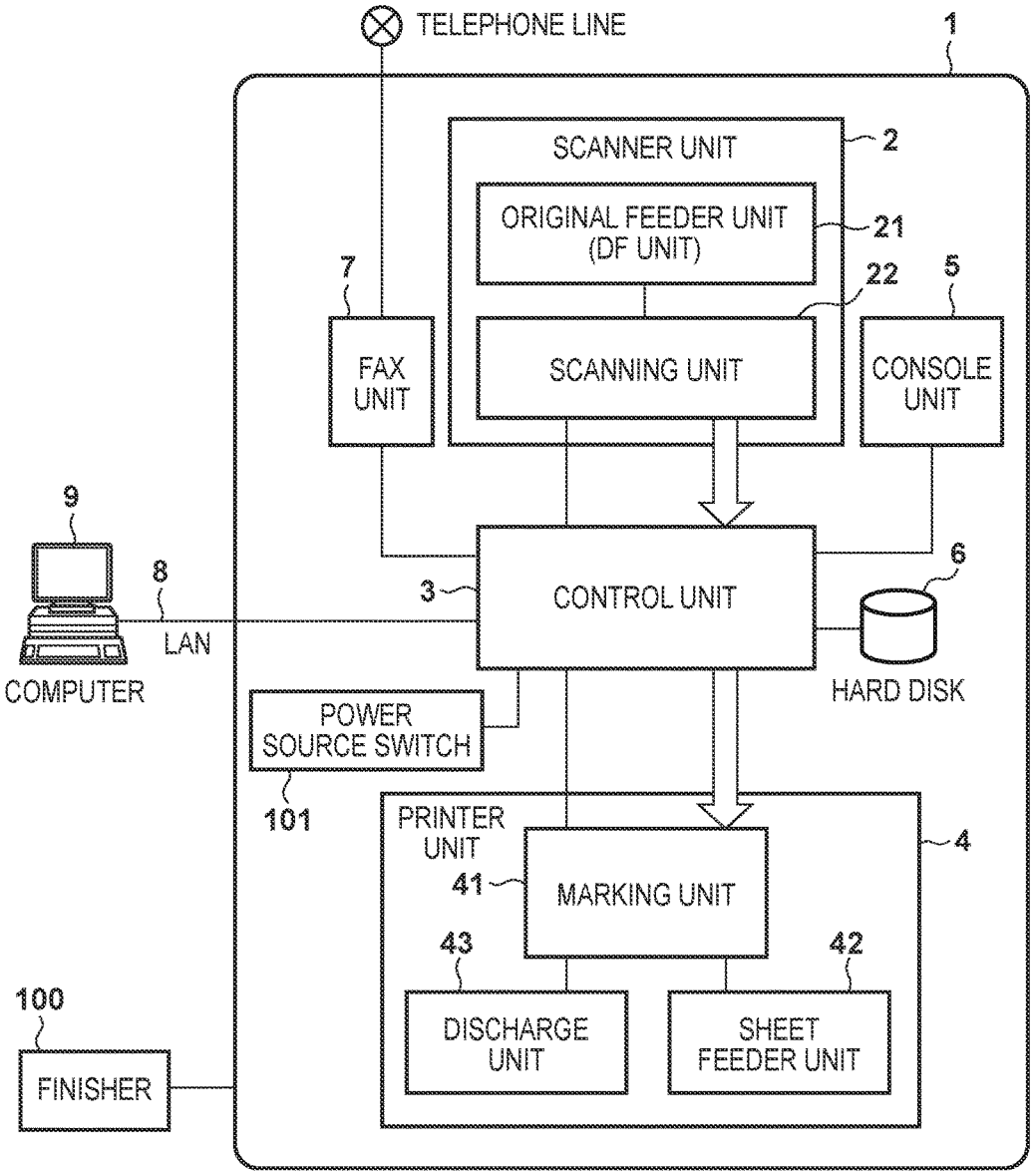
FIG. 1 is a block diagram for describing a configuration of an image forming apparatus (multifunction peripheral) according to a first embodiment.

FIG. 1 is a block diagram for describing a configuration of an image forming apparatus (multifunction peripheral) 1 according to a first embodiment.

The image forming apparatus 1 includes a scanner unit 2, a control unit 3, a printer unit 4, a console unit 5, a fax unit 7, and the like. The scanner unit 2 reads an original to generate image data corresponding to an image of the original. The printer unit 4 prints an image on paper (sheet) based on image data. The hard disk 6 stores image data, a control program, and the like. The fax unit 7 is connected to a telephone line or the like to transmit and receive image data (facsimile data). The control unit 3 outputs an instruction to each of these units to control an operation of the image forming apparatus 1. The image forming apparatus 1 can also receive and output image data from and to a computer (PC) 9 through a LAN 8, issue a job, instruct other apparatuses, and the like.

The scanner unit 2 includes an original feeder unit 21 on which a bundle of originals is placed and which conveys originals to a scanning unit 22 one at a time, and the scanning unit 22 which optically scans an original to obtain digital image data. The image data thus obtained is transmitted to the control unit 3. The printer unit 4 includes a sheet feeder unit 42 which successively feeds sheets one at a time, a marking unit 41 which prints an image on a fed sheet, and a discharge unit 43 which discharges a printed sheet.

A finisher 100 performs post-processes, such as discharging, sorting, stapling, punching, cutting, and the like, on a sheet(s) discharged from the discharge unit 43 of the printer unit 4 of the image forming apparatus 1. A power source switch 101 is a switch which turns on and off the power source of the image forming apparatus 1.

Functions possessed by the image forming apparatus 1 will now be described.

Copying Function

Image data obtained by the scanner unit 2 is stored to the hard disk 6, or printed by the printer unit 4.

Image Transmitting Function

Image data obtained by the scanner unit 2 is transmitted to the computer 9 or the like through the LAN 8.

Image Saving Function

Image data obtained by the scanner unit 2 is stored to the hard disk 6, and transmitted or printed as required.

Image Printing Function

A print job described in, for example, a page description language, which is received from the computer 9, is analyzed, and printed using the printer unit 4.

Figure 2:
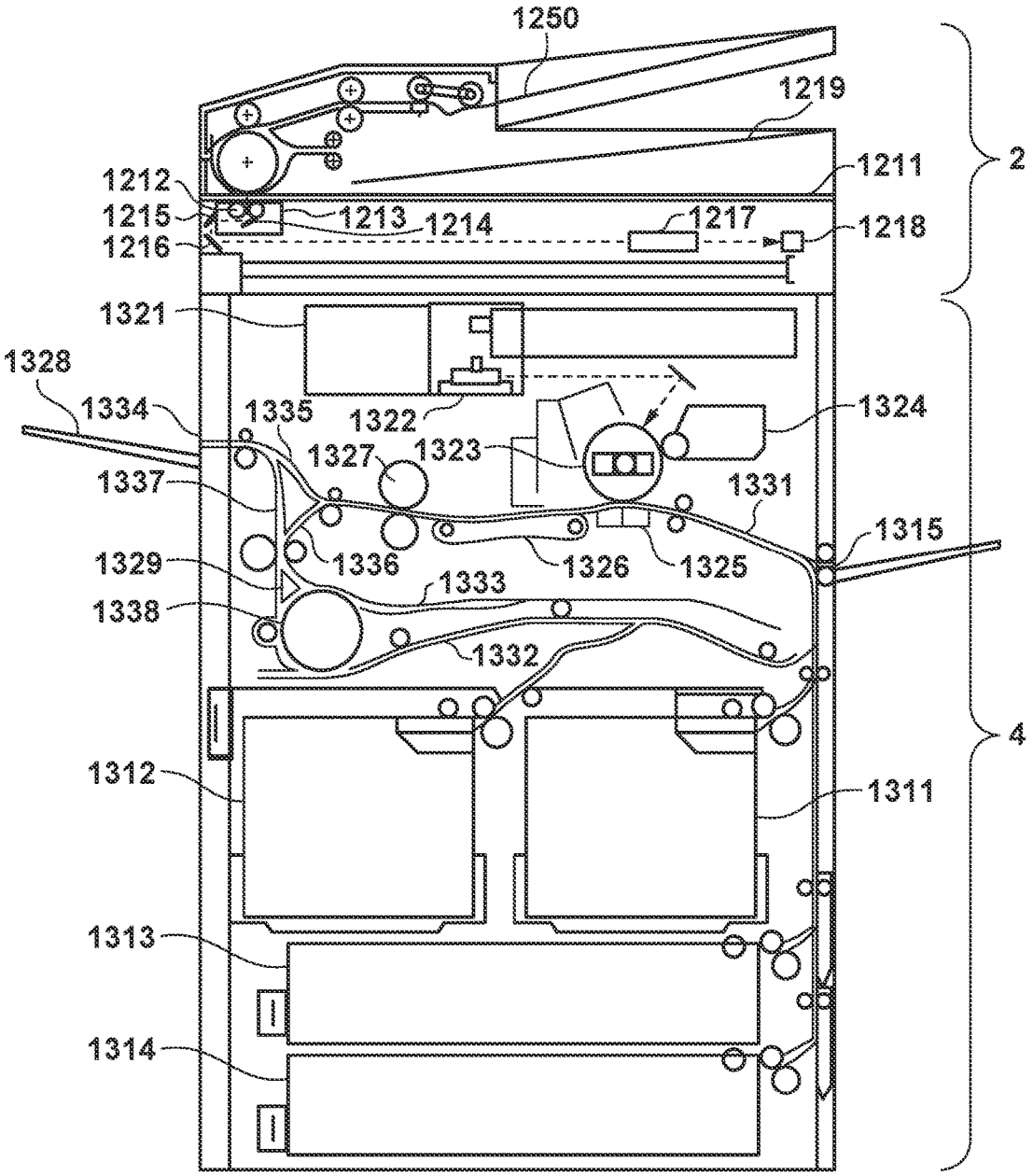
FIG. 2 is a diagram for describing a structure of the image forming apparatus of the first embodiment.

FIG. 2 is a diagram for describing a structure of the image forming apparatus 1 of the first embodiment.

In the scanner unit 2, an original feeder unit 1250 feeds originals to a glass platen 1211 one at a time, and after the end of an operation of reading each original, the original on the glass platen 1211 is discharged onto a discharge tray 1219. When an original is conveyed to the glass platen 1211, a lamp 1212 is turned on, and an optical unit 1213 starts to be moved to scan the original using light. Light reflected from the original at this time is guided by mirrors 1214-1216 and a lens 1217 to a CCD image sensor (hereinafter referred to as a CCD) 1218. Thus, an image of a scanned original is converted into image data by the CCD 1218, and after a predetermined process is performed on the image data, the resultant image data is transferred to the control unit 3.

A laser driver 1321 of the printer unit 4 drives a laser emission unit 1322 to emit laser light corresponding to image data output from the control unit 3. A photosensitive drum 1323 is irradiated with the laser light, so that a latent image corresponding to the laser light is formed on a surface of the photosensitive drum 1323. A developing material is attached by a developer 1324 to a portion of the photosensitive drum 1323 on which the latent image has been formed. Thereafter, a sheet is fed from one of cassettes 1311-1314 and a manual feed tray 1315 at a timing which is synchronous with the start of irradiation of laser light. Thereafter, the sheet is conveyed through a conveyance path 1331 to a transfer unit 1325, in which the developing material attached to the photosensitive drum 1323 is transferred to the sheet. The sheet on which the developing material has been transferred is conveyed by a conveyance belt 1326 to a fixer unit 1327, in which the developing material is fixed to the sheet by heat and pressure of the fixer unit 1327. Thereafter, the sheet which has been passed through the fixer unit 1327 is passed through conveyance paths 1335 and 1334 and then discharged to a discharge bin 1328. When the sheet is discharged to the discharge bin 1328 with the printed side being reversed, the sheet after fixing is conveyed to conveyance paths 1336 and 1338, from which the sheet is then conveyed in the opposite direction, and passed through a conveyance path 1337 and the conveyance path 1334 to be discharged. The discharge bin 1328 is removable. The sheet may be discharged to the finisher 100 through a folding apparatus (not shown).

Also, when double-sided printing is performed, the sheet which has been passed through the fixer unit 1327 is guided from the conveyance path 1336 to a conveyance path 1333 by a flapper 1329. Thereafter, the sheet is conveyed in the opposite direction, and then guided by the flapper 1329 to the conveyance path 1338 and a refeed conveyance path 1332. The sheet thus guided to the refeed conveyance path 1332 is fed to the transfer unit 1325 through the conveyance path 1331 at the above timing.

Figure 3:
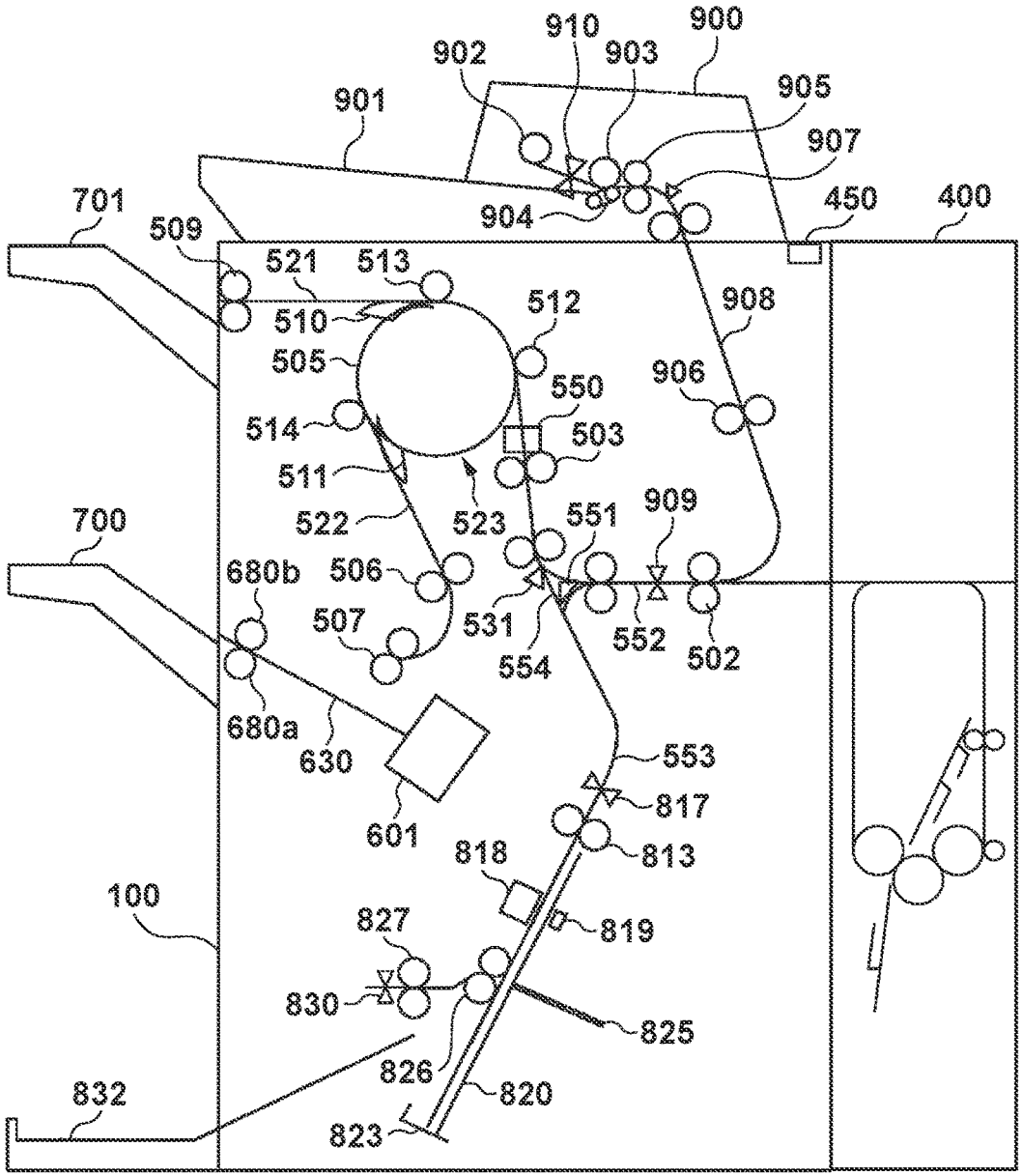
FIG. 3 is a cross-sectional view of a finisher according to the first embodiment.
Figure 4:
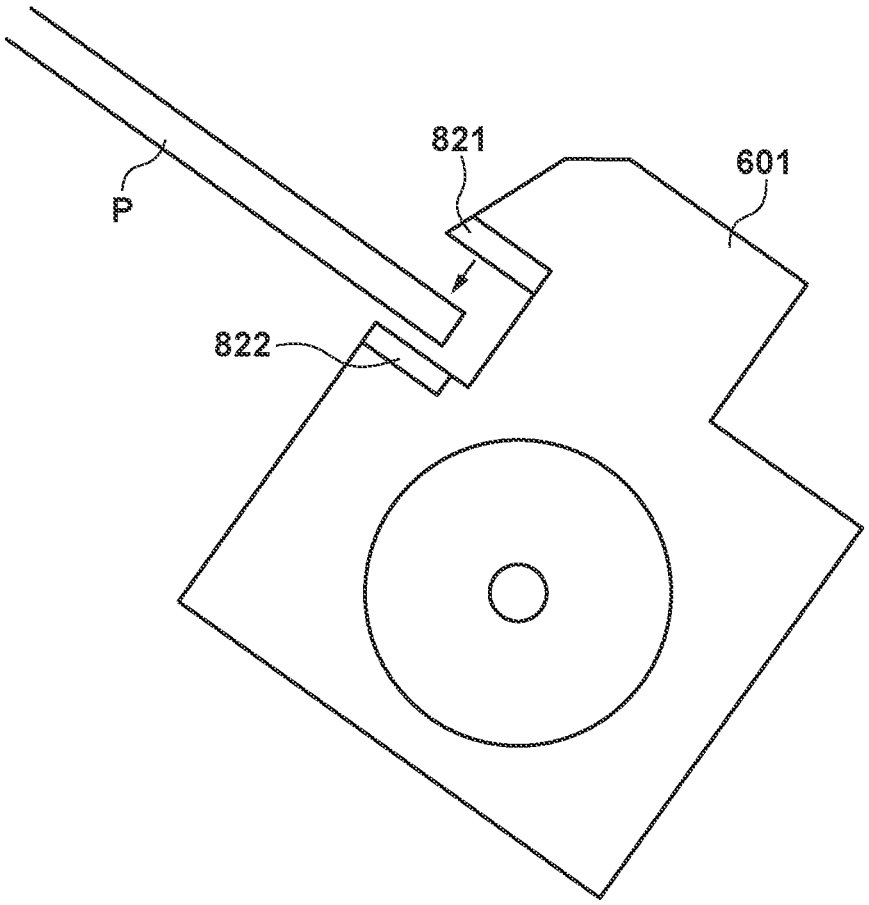
FIG. 4 is a cross-sectional view of a stapler according to the first embodiment.

Next, the finisher 100 will be described with reference to FIGS. 3 and 4. FIG. 3 is a cross-sectional view of the finisher 100. FIG. 4 is a cross-sectional view of a stapler 601.

Firstly, a finisher unit of the finisher 100 will be described. The finisher 100 successively receives discharged sheets through a folding apparatus 400. The finisher 100 performs a process of bundling a plurality of received sheets into an aligned bundle, a process of binding the bundle of sheets at the trailing edge using a staple, and a process of punching a hole the received sheets near the trailing edge. The finisher 100 also performs post-processes, such as sorting, non-sorting, bookbinding, and the like, on the sheets.

As shown in FIG. 3, the finisher 100 includes an inlet roller pair 502 for guiding a sheet discharged from the printer unit 4 through the folding apparatus 400 into the finisher 100, and a sheet thickness detection sensor 909. A switching flapper 551 for guiding a sheet to a finisher path 552 or a first bookbinding path 553 is provided downstream from the inlet roller pair 502. The sheet guided to the finisher path 552 is conveyed toward a buffer roller 505 through a transfer roller pair 503. The transfer roller pair 503 and the buffer roller 505 are allowed to rotate in opposite directions. An inlet sensor 531 is provided between the inlet roller pair 502 and the transfer roller pair 503. Also, a second bookbinding path 554 branches off from the finisher path 552 at a point upstream from and near the inlet sensor 531 in the sheet conveyance direction. The branch point forms a branch to a conveyance path for conveying a sheet from the inlet roller pair 502 to the transfer roller pair 503. The branch point also forms a branch having a one-way structure in which when the transfer roller pair 503 is rotated in an opposite direction to convey a sheet from the transfer roller pair 503 toward the inlet sensor 531, the sheet is conveyed only toward the second bookbinding path 554. A punch unit 550 is provided between the transfer roller pair 503 and the buffer roller 505. The punch unit 550 is operated as required to punch a hole at a portion near the trailing edge of a conveyed sheet.

The buffer roller 505 is a roller around which a stack of a predetermined number of conveyed sheets can be wrapped. The sheets are wrapped around the roller 505 by pressure rollers 512, 513, and 514 as required. The sheets wrapped around the buffer roller 505 are conveyed in a direction in which the buffer roller 505 is rotated. The wrapping of the sheets around the buffer roller 505 is performed to temporarily buffer or hold succeeding sheets while the stapling process is being performed at a process tray 630. The predetermined number of sheets wrapped are conveyed to the process tray 630 while they are stacked together at an appropriate time when these sheets do not collide with the previous sheet bundle.

A switching flapper 510 is provided between the pressure rollers 513 and 514. A switching flapper 511 is provided downstream from the pressure roller 514. The switching flapper 510 is a flapper for causing the sheets wrapped around the buffer roller 505 to come off the buffer roller 505 and guiding the sheets to a non-sort path 521 or a sort path 522. The switching flapper 511 is a flapper for causing the sheets wrapped around the buffer roller 505 to come off the buffer roller 505 and guiding the sheets to the sort path 522, or guiding the sheets wrapped around the buffer roller 505 while they are still wrapped around the buffer roller 505, to a buffer path 523. The sheets guided by the switching flapper 510 to the non-sort path 521 are discharged to a sample tray 701 through a discharge roller pair 509. Also, the sheets guided by the switching flapper 510 to the sort path 522 are stacked on a middle tray (hereinafter referred to as a process tray) 630 through transfer rollers 506 and 507. An alignment process, stapling process, and the like are performed, as required, on the bundle of sheets thus stacked on the process tray 630, and thereafter, the sheets are discharged to a stack tray 700 by discharge rollers 680*a* and 680*b*. The stapling process of binding the bundle of sheets stacked on the process tray 630 together is performed using the stapler 601. The stack tray 700 is configured to move up and down on its own.

FIG. 4 is a schematic diagram of the stapler 601.

In FIG. 4, a driver portion 821 serving as a contact portion moves in a direction indicated by an arrow during a stapling operation to be in contact with a sheet bundle P and press an upper surface of the sheet bundle P. At substantially the same time, a staple driving portion 822 drives a staple through the sheet bundle P. The driven staple is folded by the driver portion 821, so that the stapling process is completed. The staple driving portion 822 and the driver portion 821 may be integrally provided and may be allowed to move toward a fixed staple folding portion. Also, a sensor is provided at the driver portion 821 and the staple driving portion 822, to detect that the sheet bundle P has been inserted in an original insertion slot.

Referring back to FIG. 3, a switch 450 is a mechanical switch for operating the stapler 601. When the switch 450 is pressed in a state where the sheet bundle P has been detected by the sensor of the driver portion 821 and the staple driving portion 822, the stapler 601 is operated to perform manual stapling. The switch 450 may be replaced by a software switch which may be provided in the console unit 5, which will not be described.

Next, a saddle portion of the finisher 100 will be described. The sheets which have been passed through the first and second bookbinding paths 553 and 554, are accommodated in an accommodation guide 820 by a transfer roller pair 813, and then conveyed until the leading edge of the sheets contacts a movable sheet registration member 823. A bookbinding inlet sensor 817 is provided upstream from the transfer roller pair 813. Also, two pairs of staplers 818 are provided halfway through the accommodation guide 820. These staplers 818 are configured to bind a sheet bundle at a middle thereof in association with anvils 819 facing the staplers 818. A folding roller pair 826 is provided downstream from the staplers 818. A poking member 825 is provided at an opposite position from the folding roller pair 826. The poking member 825 is stuck out toward the sheet bundle accommodated in the accommodation guide 820 to push the sheet bundle into a nip of the folding roller pair 826. Thereafter, the sheet bundle is folded by the folding roller pair 826, and then discharged to a saddle discharge tray 832 through a discharge roller 827. A bookbinding discharge sensor 830 is provided downstream from the discharge roller 827. Also, when the sheet bundle stapled by the stapler 818 is folded, the registration member 823 is moved down by a predetermined distance after the end of the stapling process so that the sheet bundle will be stapled at a middle position of the folding roller pair 826.

Finally, an inserter unit of the finisher 100 will be described.

An inserter 900 is provided at an upper portion of the finisher 100. A bundle of sheets which are a cover or page (leaf), stacked on a tray 901, are successively separated one after another, and conveyed to the finisher path 552 or the bookbinding path 553. Here, special sheets are stacked on the tray 901 of the inserter 900 while they are directly viewed from the operator. In other words, the special sheets are stacked on the tray 901 with the surfaces thereof facing upward. The special sheets stacked on the tray 901 are conveyed by a feed roller 902 to a separation unit including a transfer roller 903 and a separation belt 904, in which the sheets are successively separated and conveyed one at a time, with the uppermost sheet first. The presence or absence of a special sheet is determined using a sheet detection sensor 910 which is provided between the feed roller 902 and the transfer roller 903 to determine whether or not a special sheet is set on the tray 901. An extraction roller pair 905 is provided downstream from the separation unit. A special sheet separated by the extraction roller pair 905 is stably guided to a conveyance path 908. A fed-sheet sensor 907 is provided downstream from the extraction roller pair 905. A transfer roller 906 for guiding a special sheet in the conveyance path 908 to the inlet roller pair 502 is provided between the fed-sheet sensor 907 and the inlet roller pair 502.

Figure 5:
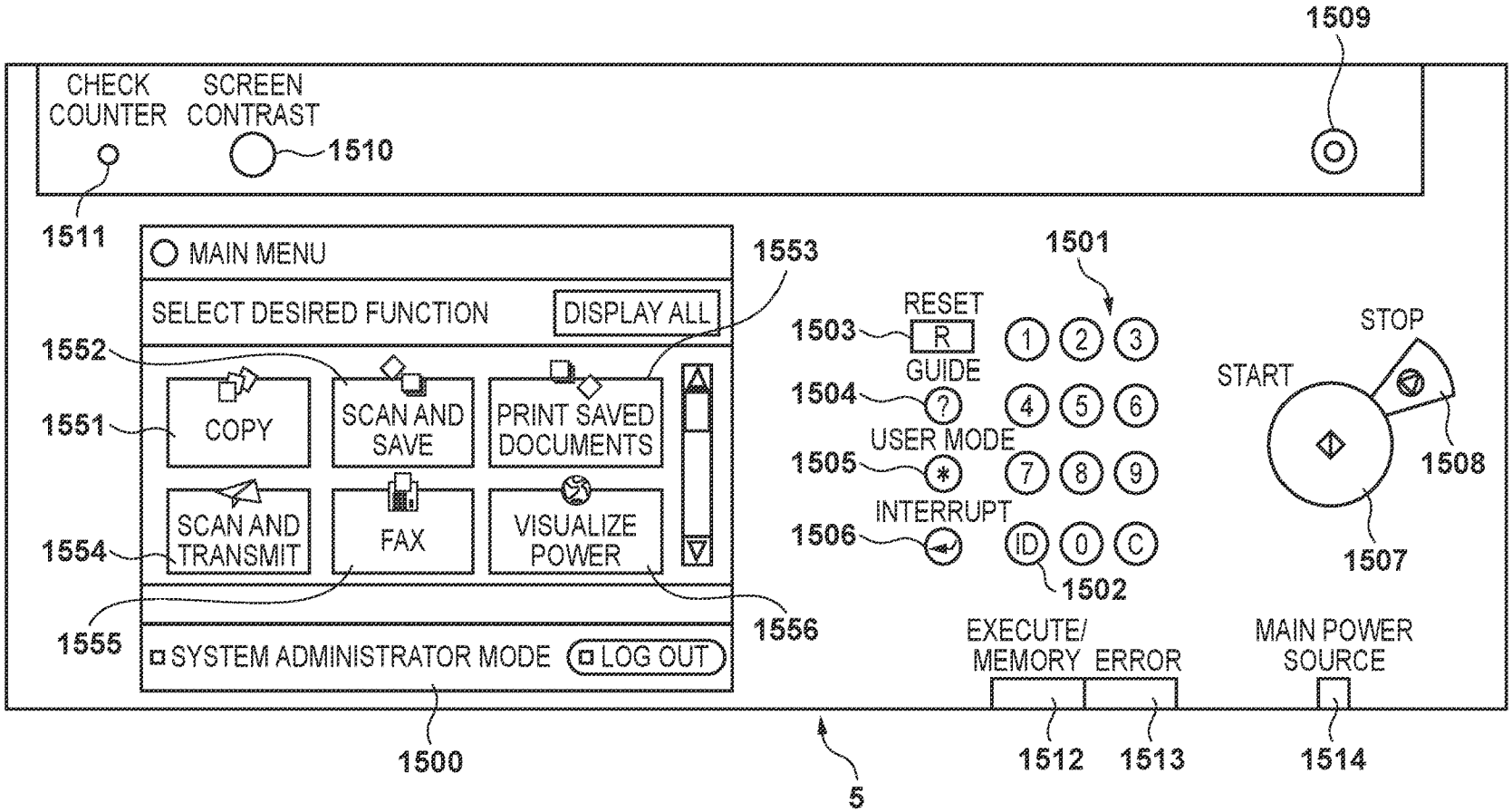
FIG. 5 is a top view of a console unit of the image forming apparatus of the first embodiment.

FIG. 5 is a top view of the console unit 5 of the image forming apparatus 1 of the first embodiment.

The console unit 5, which is connected to the control unit 3, includes a display unit having functions such as a touch-screen and the like, hard keys, and the like, to provide a user interface for operating the image forming apparatus 1. A display unit 1500 is the display unit having the touchscreen function, which is used to set main mode settings and display states. A ten-key 1501 is used to input a numerical value of 0 to 9. An ID key 1502 is used to input a department number and an identification mode when the image forming apparatus 1 is managed by a department. A reset key 1503 is used to reset current modes. A guide key 1504 is used to instruct the image forming apparatus 1 to display a screen for explaining each mode. A user mode key 1505 is used to display a user mode screen. An interrupt key 1506 is used to perform interrupt copying. A start key 1507 is used to start a copying operation. A stop key 1508 is used to stop a current copying job. A power saving key 1509 is used to shift to a sleep state. When the power saving key 1509 is pressed down, the backlight of the display unit 1500 is turned off. A contrast adjustment key 1510 is used to adjust the contrast of the display unit 1500. A counter checking key 1511 is used to display, on the display unit 1500, a count screen for showing the count of copies which have been printed before the key is pressed down. An LED 1512 is used to indicate that a job is being performed, or an image is being stored into an image memory. An error LED 1513 is turned on when the image forming apparatus 1 is in an error state, such as jam, door open, or the like. A power source LED 1514 is used to indicate that the main switch of the image forming apparatus 1 is on. Software buttons 1551-1556 are used to shift to a screen for functions of copying, scanning and saving, printing of saved documents, scanning and transmitting, faxing, and power visualizing, respectively. The button 1551 is a transition button which is used to shift to a screen for a copying function. The button 1552 is a transition button which is used to shift to a screen for a scanning and saving function of performing scanning using the scanner unit 2 and saving obtained image data to the hard disk 6. The button 1553 is a transition button which is used to shift to a screen for a saved document printing function of printing image data stored in the hard disk 6 using the printer unit 4. The button 1554 is a transition button which is used to shift to a screen for a scanning and transmitting function of transmitting image data obtained by the scanner unit 2 from the control unit 3 through the LAN 8 to the computer 9. The button 1555 is a transition button which is used to shift to a screen for a faxing function of transmitting image data obtained by the scanner unit 2 from the control unit 3 through the fax unit 7 to a telephone line. The button 1556 is a transition button which is used to shift to screen for a power visualizing function of allowing the user to check the power state of the image forming apparatus 1 on the display unit 1500.

Figure 6:
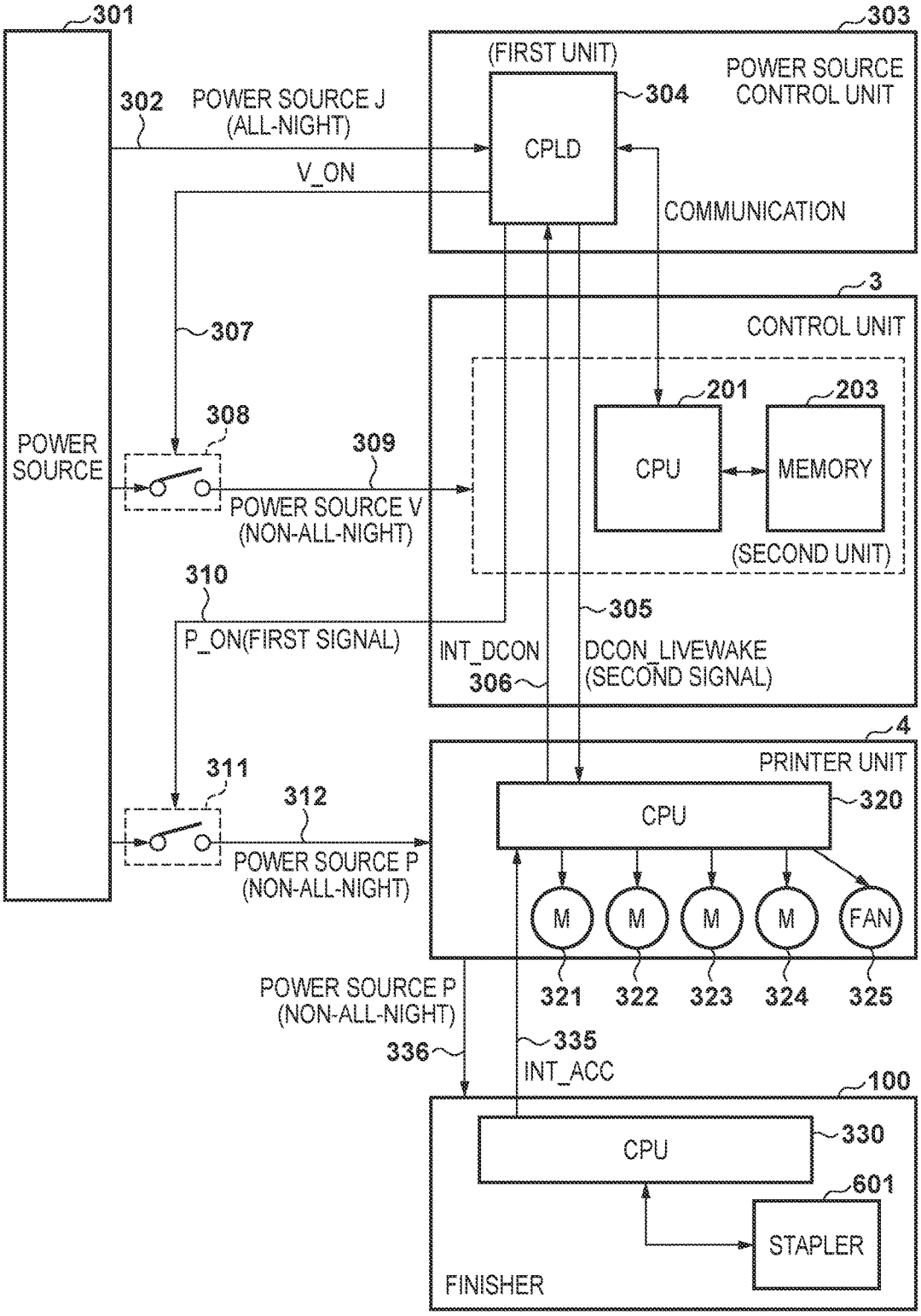
FIG. 6 is a block diagram for describing a power source system of the image forming apparatus of the first embodiment.

FIG. 6 is a block diagram for describing a power source system of the image forming apparatus 1 of the first embodiment.

Power is always supplied from a power source 301 through an all-night power source line 302 to a power source control unit 303. Note that the power consumption of the power source control unit 303 is considerably small, and therefore, in a sleep mode, power control is performed so that power is supplied only to the power source control unit 303 and a portion which serves as a factor causing the image forming apparatus 1 to return from the sleep mode. A complex programmable logic device (CPLD) 304 is a hardware logic circuit which controls start and stop of power supply to each portion of the image forming apparatus 1. The CPLD 304 is previously programmed to perform the following desired operations. Specifically, the CPLD 304 controls power supply from the power source 301 through a non-all-night power source line 309 to a control unit 3, by turning a relay switch 308 on and off using an IO signal V_ON 307. A CPU 201 sets a plurality of values for a timer. When the timer is activated, the CPLD 304 performs an operation set by the CPU 201. The CPLD 304 also controls power supply from the power source 301 through a non-all-night power source line 312 to the printer unit 4, by turning a relay switch 311 on and off using an IO signal P_ON 310. The CPLD 304 can also operate a predetermined IO signal according to an instruction from the CPU 201. The IO signal includes a DCON_LIVEWAKE signal 305 provided to a CPU 320 of the printer unit 4. When the power source of the printer unit 4 is turned on in a state where the signal 305 has been asserted, the printer unit 4 quietly returns back without performing a specific operation, such as controlling a movable portion or using power. The specific operation includes control for, such as rotating a motor, roller, polygon, or the like, adjusting the temperatures of drums 321-324, dissipating heat using a FAN 325, and the like.

The CPU 320 of the printer unit 4 notifies the CPLD 304 of interruption of a sensor or the like using an INT_DCON signal 306 for notifying of interruption. The CPLD 304, when receiving the interruption notification, turns the switch 311 on using an IO signal, i.e., the P_ON signal 310, to supply power from the power source 301 through the non-all-night power source line 312 to the printer unit 4.

A CPU 330 of the finisher 100 notifies the CPU 320 of the printer unit 4 of interruption from a sensor or the like using an INT_ACC signal 335 for notifying of interruption. The CPU 320 also notifies the CPLD 304 of the interruption using the INT_DCON signal 306. The CPLD 304, when receiving the interruption notification, turns the switch 311 on using an IO signal, i.e., the IO signal P_ON 310. As a result, power is supplied from the power source 301 through the non-all-night power source line 312, the printer unit 4, and a non-all-night power source line 336 to the finisher 100. Thus, power can also be supplied to the stapler 601 by supplying power to the finisher 100. Note that the CPLD 304 can control power supply as required, without receiving interruption. As with the printer unit 4 described above, power supply to the scanner unit 2 can be controlled by the CPLD 304, which will not be described, to avoid redundancy.

Figure 7:
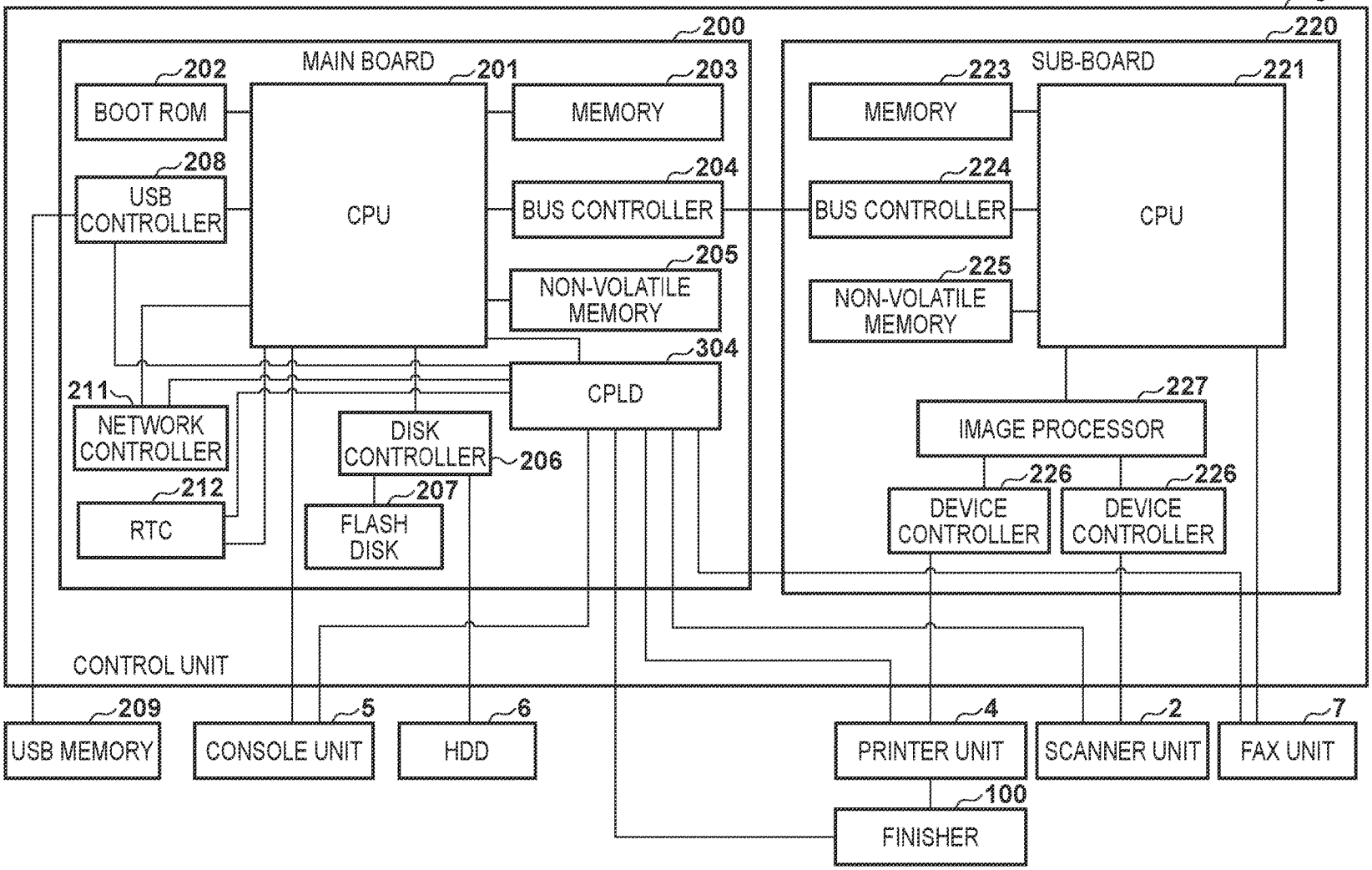
FIG. 7 is a block diagram for describing a configuration of a control unit of the image forming apparatus of the first embodiment.

FIG. 7 is a block diagram for describing a configuration of the control unit 3 of the image forming apparatus 1 of the first embodiment.

The control unit 3 includes a main board 200 and a sub-board 220. The main board 200 is a so-called general-purpose CPU circuit. The main board 200 includes the CPU 201 which controls the entire apparatus, a boot ROM 202 which contains a boot program, a memory 203 which the CPU 201 uses as a work memory, a bus controller 204 which has a bridge function with respect to an external bus, and a non-volatile memory 205. The main board 200 further includes a disk controller 206 which controls a storage device, a flash disk 207 which is a storage device having a relatively small capacity which includes a semiconductor device, a USB controller 208 which controls a USB, and the like. Moreover, a USB memory 209, the console unit 5, the hard disk 6, and the like, are connected to the main board 200. The CPU 201 is also connected to the CPLD 304 which controls interruption from each device and power supply to each device. The main board 200 further includes a network controller 211, and a real-time clock (RTC) 212, and is also connected to the console unit 5, the scanner unit 2, the printer unit 4, the fax unit 7, the finisher 100, and the like.

The sub-board 220 includes a relatively small general-purpose CPU system, and hardware for image processing. The sub-board 220 includes a CPU 221, a memory 223 which the CPU 221 uses as a work memory, a bus controller 224 which has a bridge function with respect to an external bus, a non-volatile memory 225, an image processor 227, a device controller 226, and the like. The scanner unit 2 and the printer unit 4 exchange digital image data through the device controller 226. The fax unit 7 is directly controlled by the CPU 221.

Note that FIG. 7 is a schematic block diagram. For example, although the CPU 201, the CPU 221, and the like include a large number of CPU peripheral hardware components, such as a chip set, bus bridge, clock generator, and the like, these components are not shown, for the sake of simplicity. This block configuration is not intended to limit the present invention.

Next, as an example operation of the control unit 3, image copying will be described.

When the user instructs the image forming apparatus 1 using the console unit 5 to copy an image, the CPU 201 sends an instruction to read an original to the scanner unit 2 through the CPU 221. As a result, the scanner unit 2 optically scans the original, converts an image of the original into image data, and inputs the image data to the image processor 227 through the device controller 226. The image processor 227 performs image processing on the image data, and transfers the processed image data to the memory 223 by DMA, so that the image data is temporarily saved in the memory 223. The CPU 201, when confirming that all or a predetermined amount of the image data has been stored in the memory 223, sends a print instruction to the printer unit 4 through the CPU 221. At this time, the CPU 221 notifies the image processor 227 of an address of the image data in the memory 223. The image data stored in the memory 223 is transmitted by the image processor 227 and the device controller 226 to the printer unit 4 according to a synchronization signal from the printer unit 4, and then printed.

When a plurality of copies are printed, the CPU 201 saves image data of the memory 223 to the hard disk 6, and the second copy and the following copies are printed by reading the image data from the memory 223.

Figure 8:
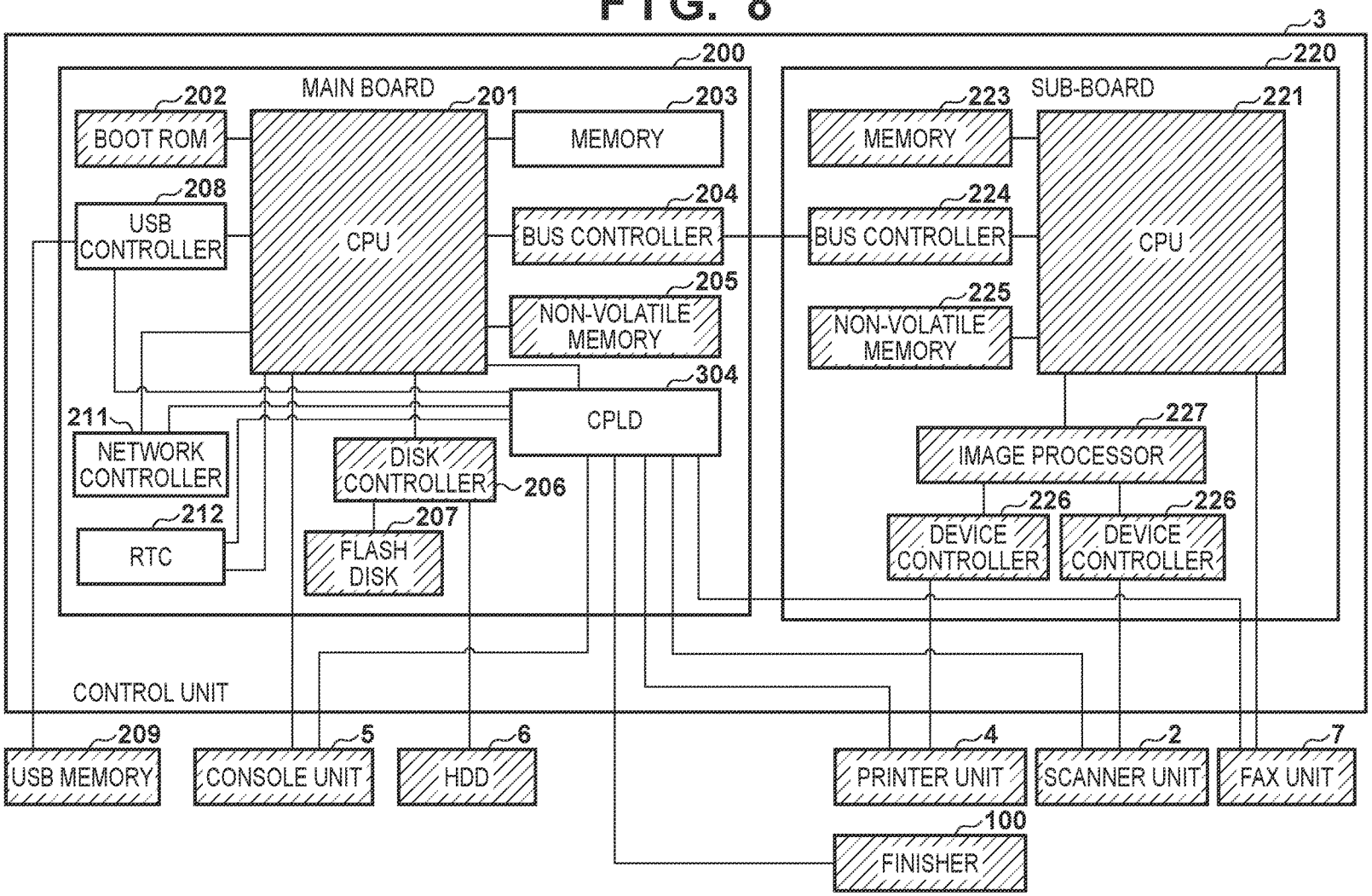
FIG. 8 is a block diagram for describing a state of power supply which occurs when the image forming apparatus of the first embodiment is in a sleep state.

FIG. 8 is a block diagram for describing a state of power supply which occurs when the image forming apparatus 1 of the first embodiment is in the sleep state. Note that this block diagram corresponds to the block diagram of FIG. 7, and the same parts as those of FIG. 7 are indicated by the same reference characters.

The sleep state refers to a state in which power consumption is reduced, and from which activation can be completed more quickly than normal activation. For example, when a predetermined period of time has passed in the absence of the user's operation, or a soft switch of the console unit 5 is pressed down, the power saving function is started, and the image forming apparatus 1 eventually enters the sleep state.

In the sleep state, power supply is limited to a minimum number of parts, such as the memory 203, CPLD 304, and the like of the control unit 3. Specifically, in the sleep state, power is supplied to parts other than those indicated by hatching in FIG. 8. Note that power is also supplied to some of the parts indicated by hatching which will be required in order for the image forming apparatus 1 to return from the sleep state.

An operation of the control unit 3 in the sleep state according to the first embodiment will now be described with reference to FIG. 8.

The parts which receive power in the sleep state include the network controller 211, RTC 212, USB controller 208, and the like which send an interrupt for returning back from the sleep state to the CPLD 304. Power is also supplied to the soft switch of the console unit 5, sensors of the scanner unit 2, printer unit 4, and finisher 100, the switch 450 (FIG. 3) of the finisher 100, some parts which detect signal arrival or off-hook of the fax unit 7, and the like.

The CPLD 304 receives at least one interrupts from parts which receives power in the sleep state. Specifically, for example, when originals are inserted in the original insertion slot while power is supplied to the sensors of the driver portion 821 and staple driving portion 822 of the stapler 601 of the finisher 100, the CPLD 304 receives an interrupt. Also, for example, when the switch 450 of the finisher 100 is pressed down while power is supplied to the switch 450, the CPLD 304 receives an interrupt. When the CPLD 304 thus receives an interrupt, the CPLD 304 notifies the CPU 201 of the occurrence of the interruption. The CPU 201, when receiving the interruption notification, performs a process of returning from the sleep state, i.e., returning the state of power supply or software to the normal state. Note that different systems have different causes of returning from the sleep state, and therefore, the power supply in the sleep state is not limited to this configuration.

Figure 9:
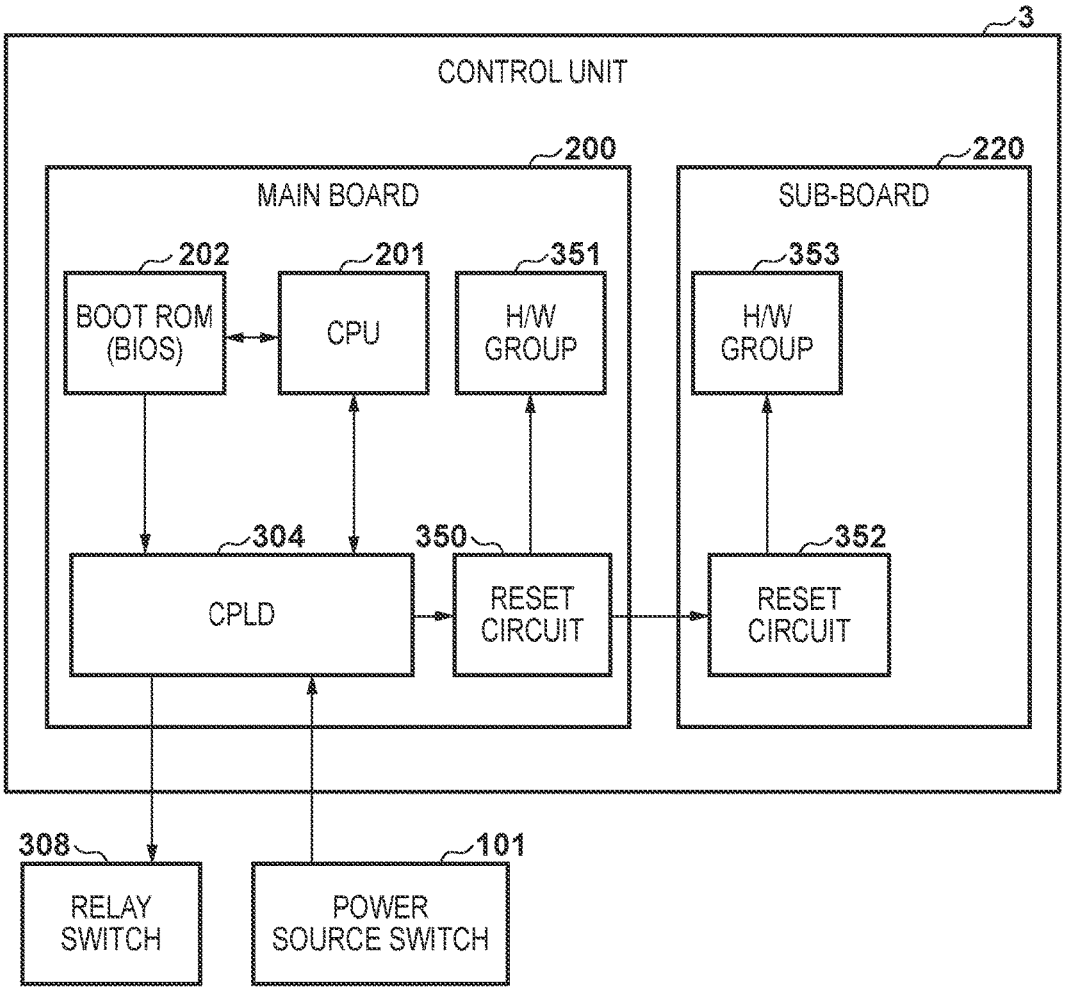
FIG. 9 is a block diagram specifically showing only a portion of the configuration of FIG. 7 including a power source control and reset circuits.

FIG. 9 is a block diagram specifically showing only a portion of the configuration of FIG. 7 including the power source control and reset circuits of the control unit 3 while schematically showing the other parts.

A reset circuit 350 is provided on the main board 200. The boot ROM 202 contains a BIOS which controls a basic portion of the hardware. As described above, the CPLD 304 monitors interruption to control power supply. A reset circuit 352 is provided on the sub-board 220. Hardware circuits 351 and 353 are provided on the boards 200 and 220, respectively, and include the controllers of FIG. 7, and the like.

An internal state of synchronous hardware is reset according to a reset signal. Therefore, in a synchronous hardware circuit, after the power source is turned on and then power is supplied to each chip, a reset circuit needs to reset each hardware component. A plurality of hardware chips have a master-slave relationship, and, therefore, are successively reset according to a designed reset sequence. Therefore, in general, as shown in FIG. 9, each board has one reset circuit, and a reset operation for each board is performed by the corresponding reset circuit.

The main board 200, which is a master board in the image forming apparatus 1, includes the CPLD 304. The CPLD 304 receives an input indicating a switch state or the like from the power source switch 101, and controls power supply to the main board 200 or the sub-board 220 using the relay switch 308. The CPLD 304, when the CPU 201 can operate normally, can reset the system according to an instruction from the CPU 201. Conversely, when power is not supplied to the CPU 201, then if the CPLD 304 receives an input of the power source switch 101, the CPLD 304 turns the relay switch 308 on so that power is supplied to the control unit 3.

The boot ROM 202 is a BIOS which contains a low-level hardware control library and the like. The boot ROM 202 is typically provided to ensure compatibility with IBM compatible machines or the like. Although the boot ROM 202 is not essential for a so-called computer system, the boot ROM 202 is provided in order to perform a portion of the power-saving functions defined in the ACPI standards. In the image forming apparatus 1 having the above hardware configuration, when the power source switch 101 is turned off, the CPU 201 is notified of a state of the power source switch 101 through the CPLD 304. Specifically, upon detecting that the power source is off, the CPU 201 typically starts a shut-down sequence, and instructs the CPLD 304 to shut down. As a result, the relay switch 308 is turned off using the IO signal V_ON 307, so that power supply from the power source 301 through the non-all-night power source line 309 to the control unit 3 is stopped, and therefore, the shut-down operation is completed. Because the execution of the program by the CPU 201 is also completed by the shut-down operation, the program of the CPU 201 is normally activated when the power source switch 101 is turned on at the next time.

Next, power supply which is performed when the image forming apparatus 1 is activated will be additionally described. When the operator uses the image forming apparatus 1, the operator turns the power source switch 101 on. The CPLD 304, upon detecting that the power source is turned on, turns the relay switch 308 on using the IO signal N_ON 307 so that power is supplied from the power source 301 through the non-all-night power source line 309 to the control unit 3. As a result, the CPU 201 initializes the hardware. The initialization of the hardware includes initialization of a register, initialization of interruption, registration of a device driver during activation of a kernel, initialization of a display unit, and the like. Next, the CPU 201 initializes the software. The initialization of the software includes calling of an initialization routine of each library, activation of a process or thread, activation of a software service which communicates with the printer unit 4 or the scanner unit 2, displaying of a display unit, and the like. After the end of the initialization process, the CPU 201 shifts to an idle state. Thereafter, power is supplied to the scanner unit 2, the printer unit 4, the finisher 100, and the like. The CPUs of the printer unit 4, scanner unit 2, and finisher 100 each start an initialization operation which is performed when the power source is turned on.

Next, power supply which is performed in a normal state in which the printer unit 4 or scanner unit 2 of the image forming apparatus 1 is not used, will be additionally described. The normal state includes not only a state in which power is supplied to all units, but also, for example, a state in which power is not supplied to the printer unit 4 while printing is not being performed, a state in which power is not supplied to the scanner unit 2 while the display of the console unit 5 is off and the user is not present in front of the image forming apparatus 1, and the like. Also, power is always supplied to the printer unit 4 or the scanner unit 2 in order to quickly complete the printing operation of the printer unit 4 or the reading operation of the scanner unit 2. However, there are a state in which a motor or polygon for printing is not operated, a state in which the temperature of a transfer unit for printing is not adjusted, and an operation wait state in which home position detection for reading an original is not activated.

Next, power supply in a state in which the printer unit 4 or the scanner unit 2 is used when the image forming apparatus 1 receives and prints PDL data, will be additionally described.

Turning on and off of the power source of the printer unit 4 in the printing function will be described. The CPU 201 of the control unit 3, when receiving print data from the computer 9 through the LAN 8, stores the print data to the memory 203. The CPU 201 analyzes the received print data, and when performing printing, generates a print job. The CPU 201 turns the switch 311 on using the IO signal P_ON 310 so that power is supplied to the printer unit 4. When the printer unit 4 is thus enabled, the CPU 201 performs the print job. The CPU 201 transmits data from the memory 203 through the bus controllers 204 and 224, the image processor 227, and the device controller 226 to the printer unit 4. The printer unit 4 prints the received data, and after the end of the printing, notifies the CPU 201 of the result. After the end of the printing, the CPU 201 causes the CPLD 304 to output the IO signal P_ON 310, thereby switching the relay switch 311 off, so that power supply from the power source 301 through the non-all-night power source line 312 to the printer unit 4 is stopped.

Figure 10:
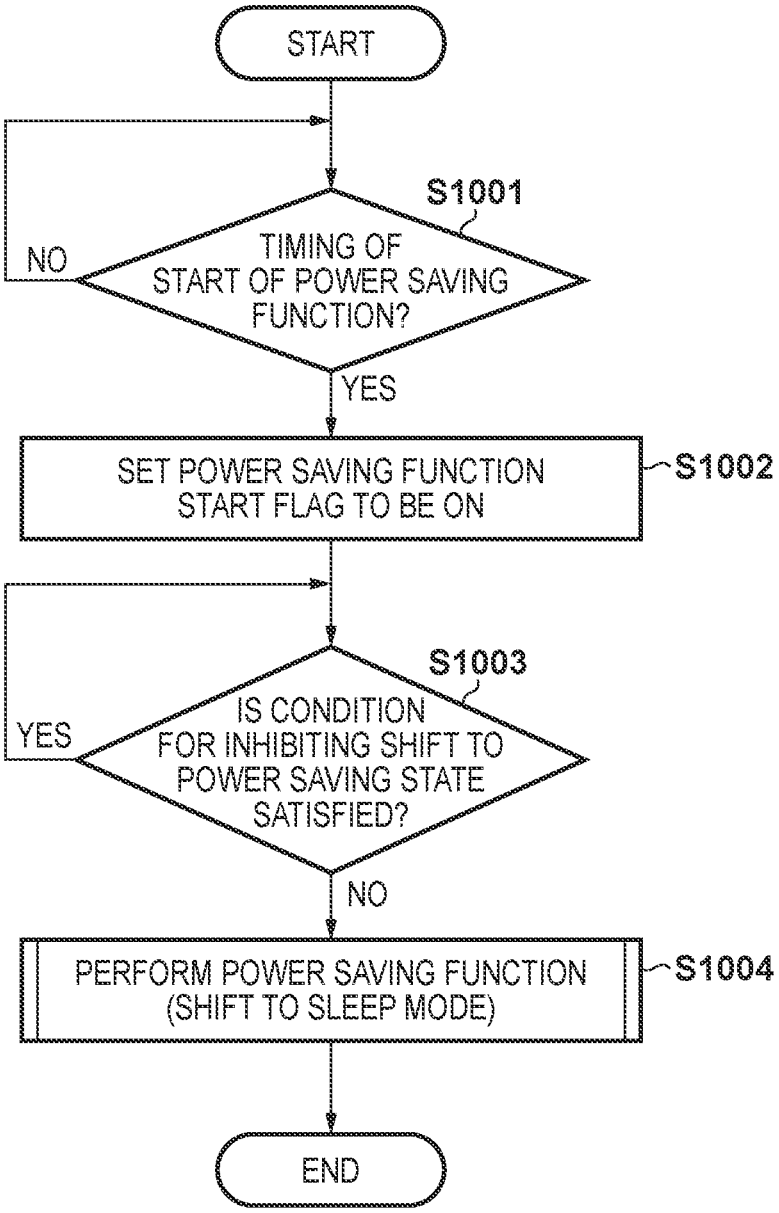
FIG. 10 is a flowchart for describing a process which is performed when the image forming apparatus of the first embodiment shifts to a sleep state (power saving state).

FIG. 10 is a flowchart for describing a process which is performed when the image forming apparatus 1 of the first embodiment shifts to the sleep state (power saving state). A program for performing this process is loaded from an HDD 6 to the memory 203 when the program is executed, and the process is achieved by the CPU 201 executing the program.

Initially, in step S1001, the CPU 201 determines whether or not a timing at which the power saving function is started has come. The timing at which the power saving function is started is, for example, when the automatic sleep timer expires, when the automatic sleep time comes, when the automatic shut-down timer expires, when the automatic shut-down time comes, or the like. Here, if it is determined that the timing at which the power saving function is started has come, control proceeds to step S1002, in which the CPU 201 sets a flag (not shown) indicating the start of the power saving function to be on. The flag, which is provided in the memory 203, indicates that the timing at which the power saving function is started has come.

Next, control proceeds to step S1003, in which the CPU 201 determines whether or not an inhibition condition for actually shifting to the power saving state is satisfied. The inhibition condition is, for example, that a print job is being performed when the timing at which the power saving function is started has come. This inhibition condition is set for preventing the occurrence of a drawback that if a print job which is being performed is interrupted by the power saving function, a desired printed material cannot be obtained. If it is determined in step S1003 that the inhibition condition is satisfied, the CPU 201 waits until the inhibition condition is determined not to be satisfied in step S1003, i.e., control proceeds to step S1004 after the inhibition condition is determined not to be satisfied in step S1003. In step S1004, the CPU 201 effects the power saving state so that the image forming apparatus 1 shifts to the sleep state.

Thus, when the timing at which the power saving function is started has come and the image forming apparatus 1 is allowed to shift to the power saving state, the image forming apparatus 1 shifts to the sleep state (power saving state).

A process which is performed when the power saving function of the first embodiment is performed will be described with reference to FIGS. 11A and 11B.

Figure 11A:
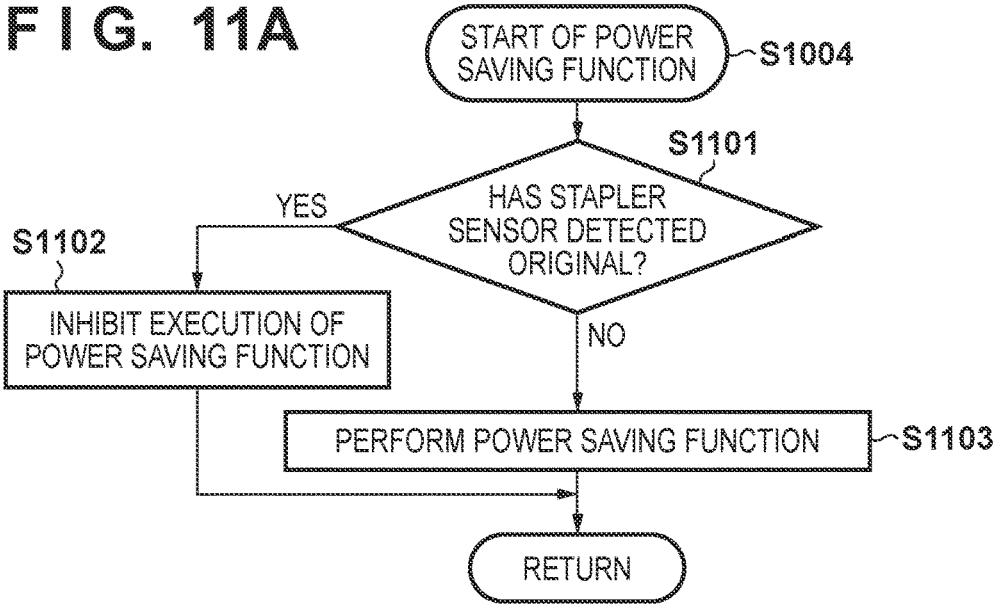
FIG. 11A is a flowchart for describing a process according to the first embodiment which is performed when a power saving function is performed in step S1004 of FIG. 10.

FIG. 11A is a flowchart for describing a process according to the first embodiment which is performed when the power saving function is performed in step S1004 of FIG. 10.

Here, in step S1101, the CPU 201 determines whether or not the sensor at the original insertion slot of the manual stapler has detected an original. If an original has been detected, control proceeds to step S1102, in which the CPU 201 does not perform the power saving function. Note that, at this time, the flag set in the above step S1002 may be set to be off. On the other hand, if an original has not been detected in step S1101, control proceeds to step S1103, in which the CPU 201 performs control for performing the power saving function.

As a result, even when the manual stapling function and the power saving function are simultaneously enabled, the drawback that the image forming apparatus 1 shifts to the power saving state during execution of manual stapling can be overcome. Specifically, when the manual stapling function is being performed, even if there is a notification that a condition under which the image forming apparatus 1 shifts to the power saving state is satisfied by the shut-down operation, sleep timer, or the like, the image forming apparatus 1 does not shift to the power saving state as long as an original for manual stapling is set. Note that, as described above, the shift to the power saving state is triggered by the automatic sleep timer, automatic sleep time, automatic shut-down timer, automatic shut-down time, or the like.

Second Embodiment

Figure 11B:
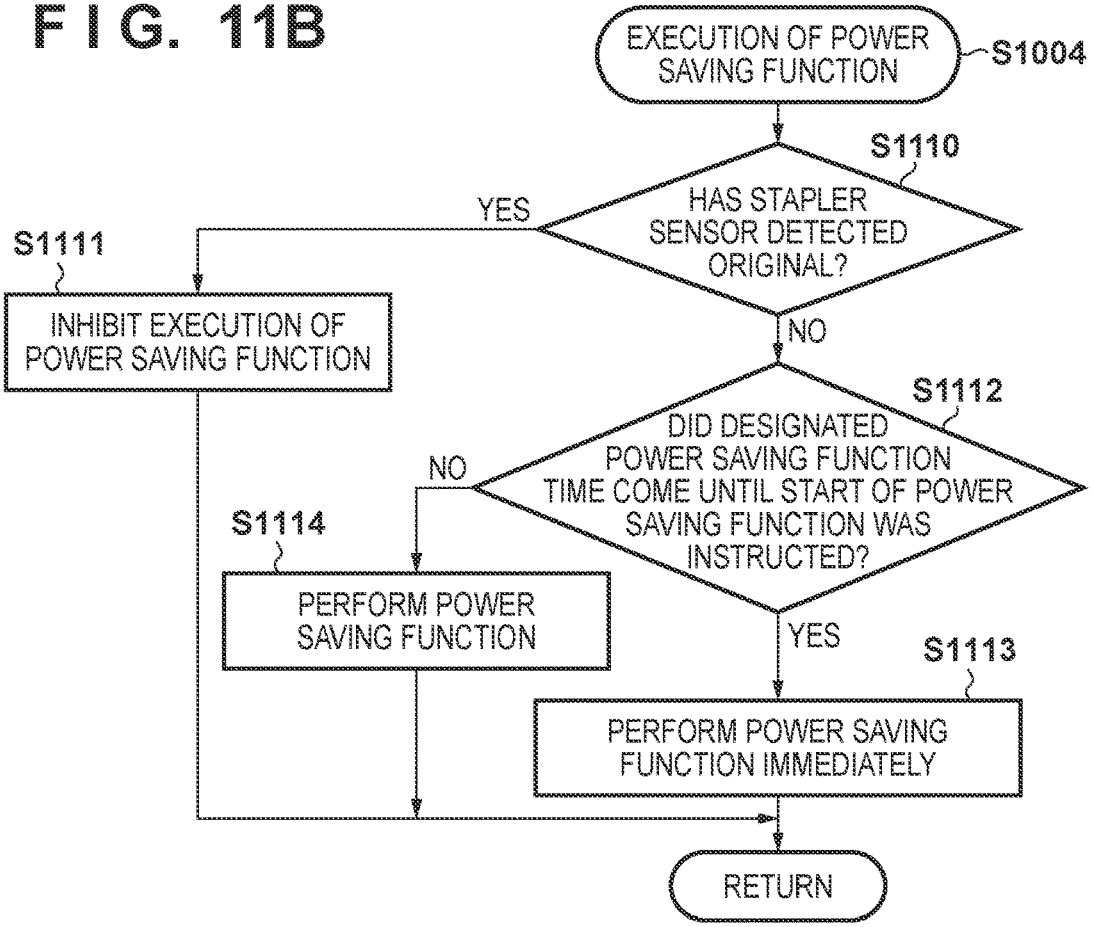
FIG. 11B is a flowchart for describing a process according to a second embodiment which is performed when the power saving function is performed in step S1004 of FIG. 10.

FIG. 11B is a flowchart for describing a process according to a second embodiment which is performed when the power saving function is performed in step S1004 of FIG. 10. Note that an image forming apparatus 1 according to the second embodiment has a configuration similar to that of the first embodiment, and therefore, the configuration will not be described.

In the second embodiment, a process will be described which is performed in a state where an inhibition condition under which the power saving function cannot be performed is satisfied so that the power saving function is not performed, and even if, for example, the automatic sleep timer notifies that the power saving start time has come, the power saving function cannot be performed.

In step S1110, as in the above step S1101, the CPU 201 determines whether or not an original is present in the original insertion slot of the manual stapler. If the determination result is positive, control proceeds to step S1111, in which the power saving function is caused not to be performed. On the other hand, if the determination result is negative in step S1110, control proceeds to step S1112, in which the CPU 201 determines whether or not the power saving function start time came, i.e., the shut-down timer, sleep timer, or the like expired in a state where an original was detected and therefore the power saving function was not performed. If the determination result is positive, control proceeds to step S1113, in which the CPU 201 immediately performs the power saving function which was not performed even when the start time came, and ends this process. As a result, if it was instructed to start the power saving function based on the shut-down timer, sleep timer, or the like in a state where the power saving function was not able to be performed due to detection of an original by the sensor of the manual stapler, the power saving function can be immediately performed. On the other hand, if the start time did not come, control proceeds to step S1114, in which the CPU 201 performs the power saving function according to the normal procedure.

Thus, according to the second embodiment, when an original is present in the original insertion slot of the stapler 601, the execution of the power saving function of the stapler 601 can be stopped. Also, when an original is not present in the original insertion slot of the stapler 601, the power saving function which has not been performed, due to the previous presence of an original in the insertion slot, can be performed.

Third Embodiment

A third embodiment of the present invention will be described with reference to FIGS. 12A and 12B. Note that an image forming apparatus 1 according to the third embodiment has a configuration similar to that of the first embodiment, and therefore, the configuration will not be described.

The third embodiment is directed to an image forming apparatus which has a state in which the power source of the finisher 100 is on, a state in which the power source of the finisher 100 is off, and a state in which the power source of the finisher 100 is in an intermediate state between these states. When the image forming apparatus is in the intermediate state in which the power source shifts from the on state to the off state, then if the user tries to activate the manual stapler 601, the power source of the finisher 100 is turned off during the activation of the manual stapler 601.

Therefore, in order to solve such a problem, in the third embodiment, when an original is present in the original insertion slot of the stapler 601, the turning off of the power source of the stapler 601 is delayed.

Figure 12A:
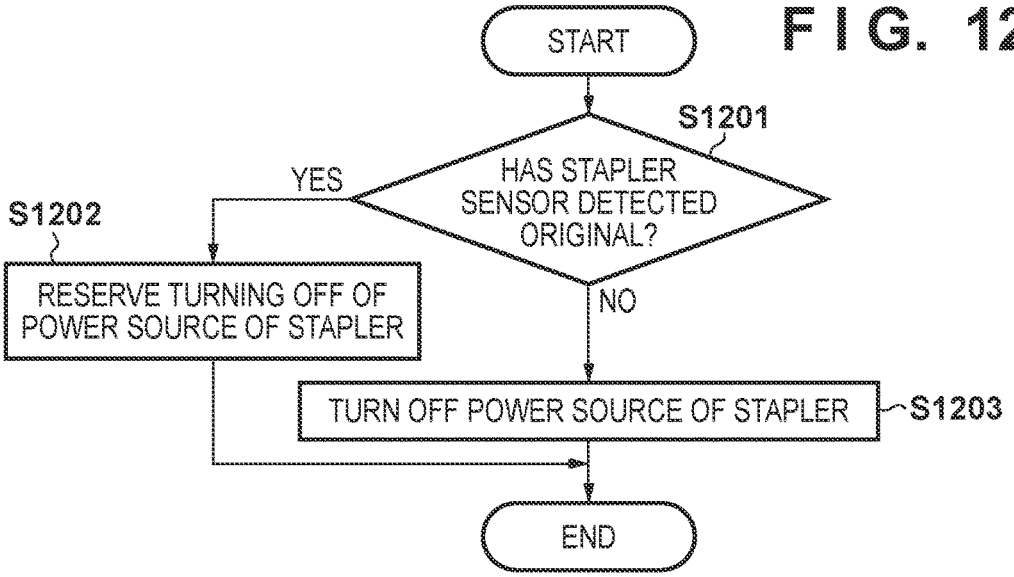
FIG. 12A is a flowchart for describing a process of an image forming apparatus according to a third embodiment.

FIG. 12A is a flowchart for describing a process of the image forming apparatus 1 of the third embodiment.

This process is started when the stapler 601 is caused to enter the power source off state by a power saving process, such as a shut-down process, sleep process, or the like. In step S1201, when the CPU 201 starts the shut-down process, the CPU 201 determines whether or not an original is present in the original insertion slot of the stapler 601 of the finisher 100, by detection using the original detection sensor. Here, if the determination result is positive, control proceeds to step S1202, in which the CPU 201 does not immediately turn off the power source of the stapler 601, and instead, reserves turning off of the power source and ends the turning-off process. On the other hand, if the determination result is negative in step S1201, control proceeds to step S1203, in which the CPU 201 turns off the power source of the stapler 601. Even when the turning off of the power source is reserved, the power source is immediately turned off.

Thus, according to the third embodiment, when an original is present in the original insertion slot of the stapler 601, the execution of the power saving process of the stapler 601 can be delayed.

Fourth Embodiment

Figure 12B:
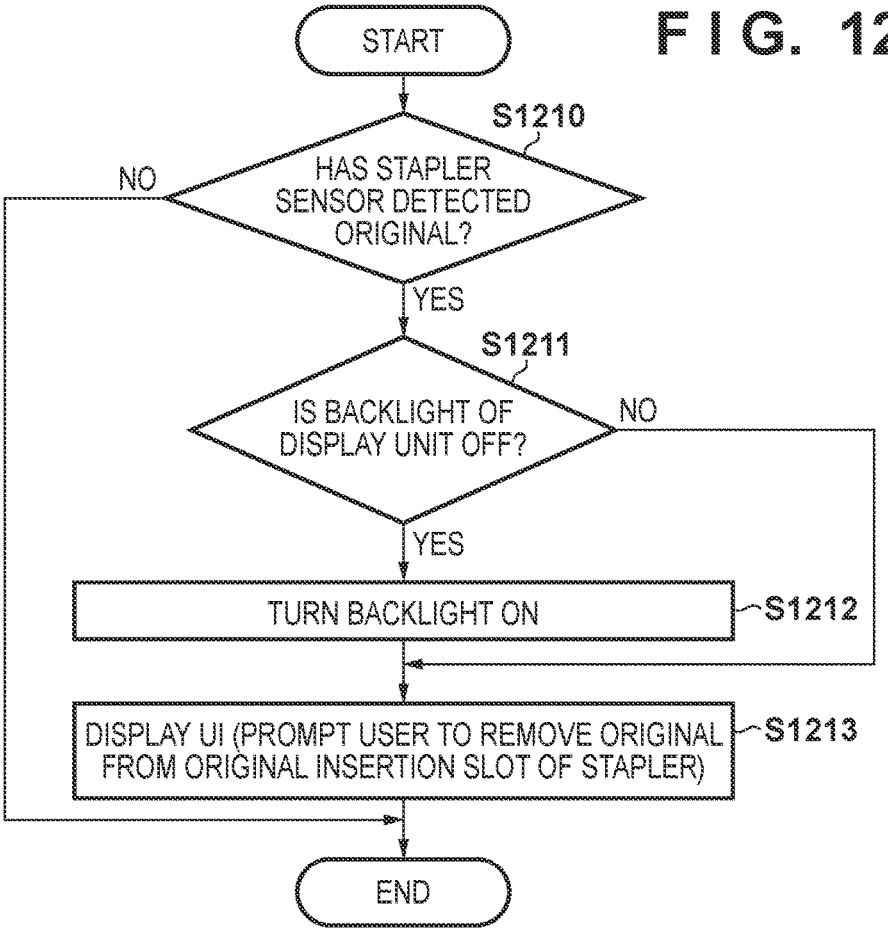
FIG. 12B is a flowchart for describing a process of an image forming apparatus according to a fourth embodiment.

FIG. 12B is a flowchart for describing a process of an image forming apparatus 1 according to a fourth embodiment. Note that the image forming apparatus 1 of the fourth embodiment has a configuration similar to that of the first embodiment, and therefore, the configuration will not be described.

The fourth embodiment is directed to a drawback that when the display unit 1500 of the image forming apparatus 1 is off, then if the manual stapler is shut down, the finisher 100 is suddenly disabled without the user's knowledge. In the fourth embodiment, when the display unit 1500 is off and an original has been detected in the original insertion slot of the manual stapler, then if the shut-down process is performed, power is supplied to the display unit 1500 so that the display unit 1500 is turned on to display a message to the user. As a result, the user can recognize that the manual stapler has been shut down, based on the message displayed on the display unit 1500.

In step S1210, the CPU 201 determines whether or not an original is present in the original insertion slot of the stapler 601 of the finisher 100, and if the determination result is negative, the process is directly ended. On the other hand, if the determination result is positive, control proceeds to step S1211, in which the CPU 201 determines whether or not the backlight of the display unit 1500 is off. If the determination result is negative, control proceeds to step S1213. If the determination result is positive, control proceeds to step S1212, in which the CPU 201 turns on the backlight of the display unit 1500, and proceeds to step S1213. In step S1213, the CPU 201 displays a message which instructs the user to remove an original from the original insertion slot of the stapler 601, on the display unit 1500, and ends the process.

As described above, according to the fourth embodiment, the user of the image forming apparatus can be notified of the shut-down process of the manual stapler.

Fifth Embodiment

Figure 13:
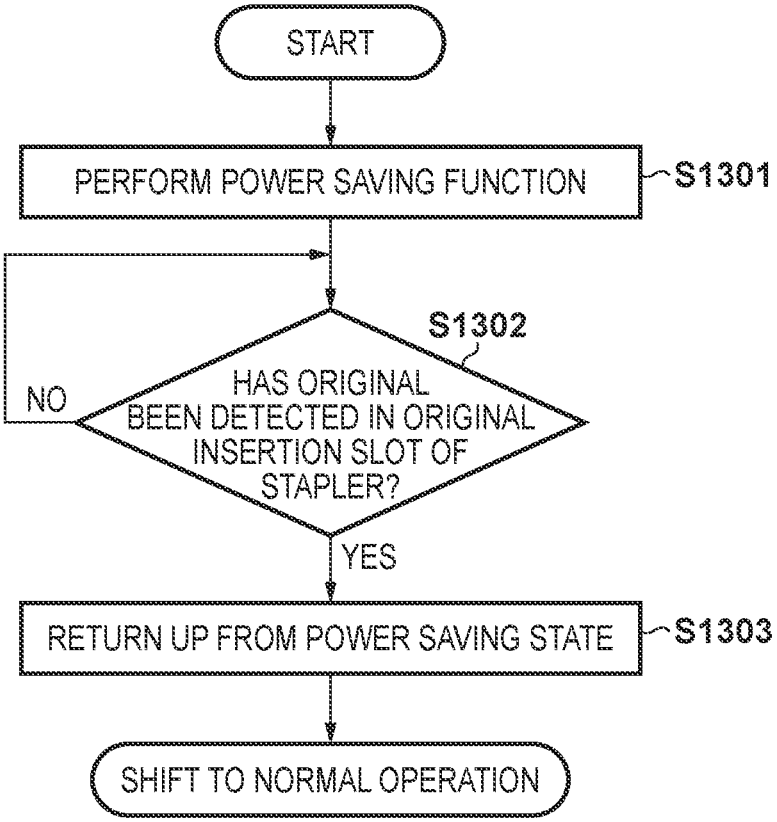
FIG. 13 is a flowchart for describing a process of an image forming apparatus according to a fifth embodiment.

FIG. 13 is a flowchart for describing a process of an image forming apparatus 1 according to a fifth embodiment. Note that the image forming apparatus 1 of the fifth embodiment has a configuration similar to that of the first embodiment, and therefore, the configuration will not be described.

The fifth embodiment is directed to a drawback that when the image forming apparatus 1 is in the power saving state, then even if the user inserts an original into the original insertion slot of the stapler 601 in order to perform manual stapling, the stapling is not allowed.

The CPU 201 starts this process when the image forming apparatus 1 shifts to the sleep state. Initially, in step S1301, the CPU 201 performs the power saving function, so that the image forming apparatus 1 shifts to the sleep state. Next, control proceeds to step S1302, in which the CPU 201 determines whether or not an original has been detected in the original insertion slot of the stapler 601 of the finisher 100. As described above, when the CPU 330 of the finisher has detected an original in the original insertion slot, the CPU 330 notifies the CPLD 304 of the presence of the original. As a result, the CPLD 304 turns the switch 308 on using the signal V_ON 307, so that power supply to the control unit 3 is started to activate the CPU 201, which then recognizes the presence of the original. If the CPU 201 has detected in step S1302 that an original is present in the original insertion slot of the stapler 601 of the finisher 100, control proceeds to step S1303. In step S1303, the CPU 201 returns from the power saving state, and ends the process.

Specifically, in step S1303, the CPU of the finisher 100, upon detecting an original using the sensor of the stapler 601, notifies the CPLD 304 of the presence of the original using the interrupt signal INT_ACC 335. As a result, the CPLD 304 turns the relay switch 308 on using the IO signal V_ON 307, so that power is supplied to the control unit 3, and the CPU 201 returns from the sleep state.

According to the fifth embodiment, when the image forming apparatus 1 is in the power saving state, then if the stapler 601 is to be used, the stapler 601 is allowed to be used even by setting an original in the stapler 601, without the need to press the power saving key for returning back from the power saving state.

Sixth Embodiment

Figure 14:
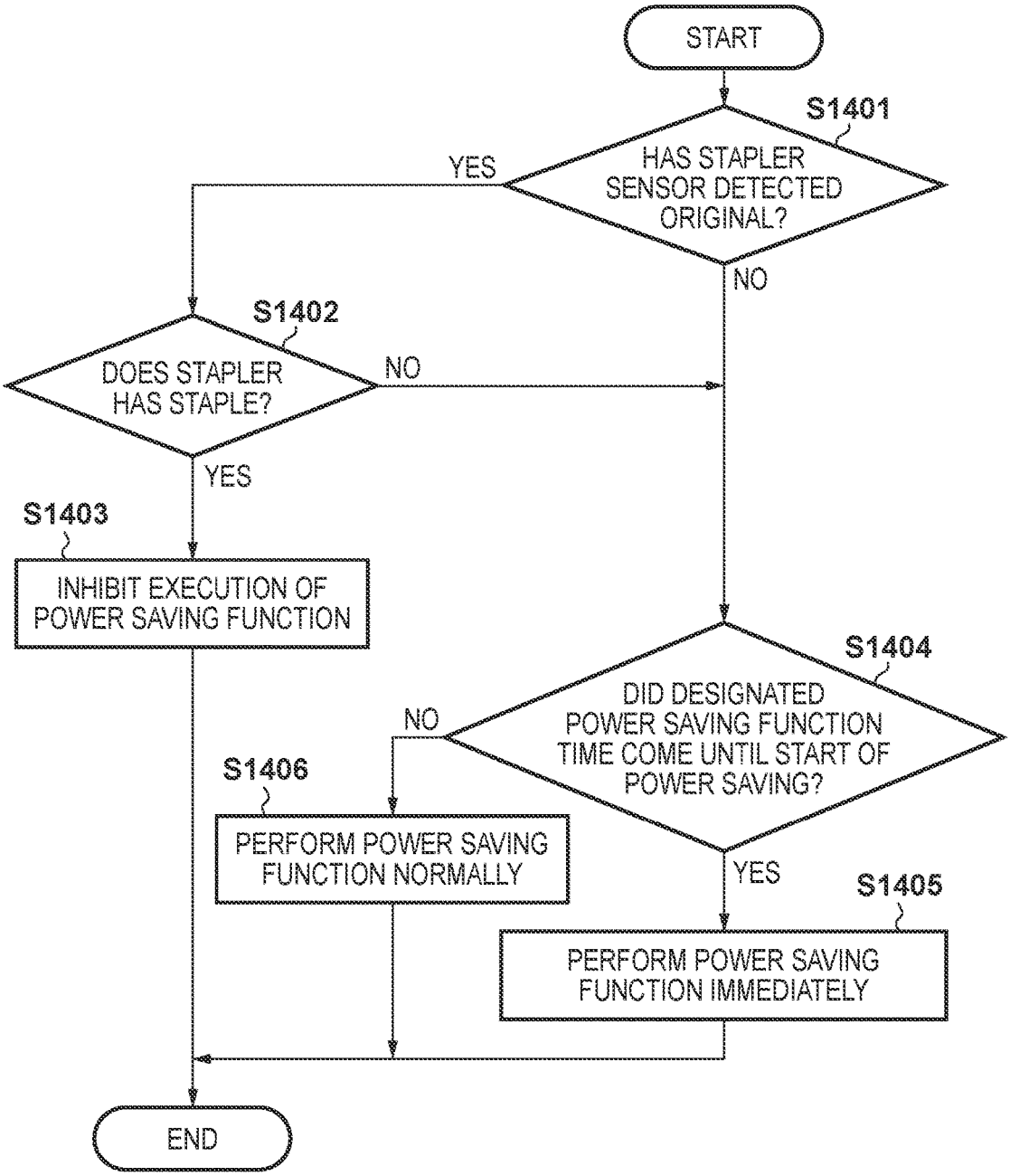
FIG. 14 is a flowchart for describing a process of an image forming apparatus according to a sixth embodiment.

FIG. 14 is a flowchart for describing a process of an image forming apparatus 1 according to a sixth embodiment. Note that the image forming apparatus 1 of the sixth embodiment has a configuration similar to that of the first embodiment, and therefore, the configuration will not be described.

In the sixth embodiment, when the stapler 601 does have a staple, then even if an original has been detected in the original insertion slot of the stapler 601, the power saving function is performed. For example, when the stapler 601 does not have a staple, then if a condition for shifting to the sleep state is satisfied, the image forming apparatus 1 shifts to the sleep state until the user has set staples in the stapler 601.

Initially, in step S1401, the CPU 201 determines whether or not an original is present in the original insertion slot of the stapler 601 of the finisher 100. If the determination result is positive, control proceeds to step S1402, in which the CPU 201 determines whether or not a staple is present in the staple driving portion 822 of the stapler 601. If the determination result is positive, control proceeds to step S1403, in which the CPU 201 inhibits the execution of the power saving function, and ends the process. At this time, timers and the like for the power saving function are not stopped.

On the other hand, if it is determined in step S1401 that an original is not present, or it is determined in step S1402 that a staple is not present at the staple driving portion 822 of the stapler 601, control proceeds to step S1404. In step S1404, as in step S1112 of FIG. 11B, the CPU 201 determines whether or not the power saving function start time came, i.e., the shut-down timer, sleep timer, or the like expired while an original was detected and therefore the power saving function was not performed. If the determination result is positive, control proceeds to step S1403, in which the CPU 201 immediately performs the power saving function which was not performed at the start time. On the other hand, if the start time did not come, control proceeds to step S1406, in which the CPU 201 performs the power saving function according to the normal procedure.

As described above, according to the sixth embodiment, when a staple is not present at the staple driving portion 822 of the stapler 601 of the finisher 100, the power saving function can be caused not to be stopped. As a result, a situation that while the stapler cannot be used, the power saving function cannot be performed due to the finisher process, can be prevented from occurring.

Seventh Embodiment

Next, a seventh embodiment of the present invention will be described. In the seventh embodiment, the finisher 100 has a separate power source, and can perform manual stapling on its own, and therefore, the image forming apparatus 1 can shift to the power saving state.

Specifically, when the power saving time comes, e.g., the shut-down or sleep timer expires while the power saving function is inactive, i.e., for a period of time from the end of power saving to the start of power saving, the power saving function is immediately performed if the finisher 100 has a separate power source. Also, in the seventh embodiment, as in the second embodiment, the execution of the power saving function is delayed. However, instead of delaying the execution of the power saving function, the execution of the power saving function may be inhibited as in the first embodiment, which will not be described, to avoid redundancy.

Figure 15:
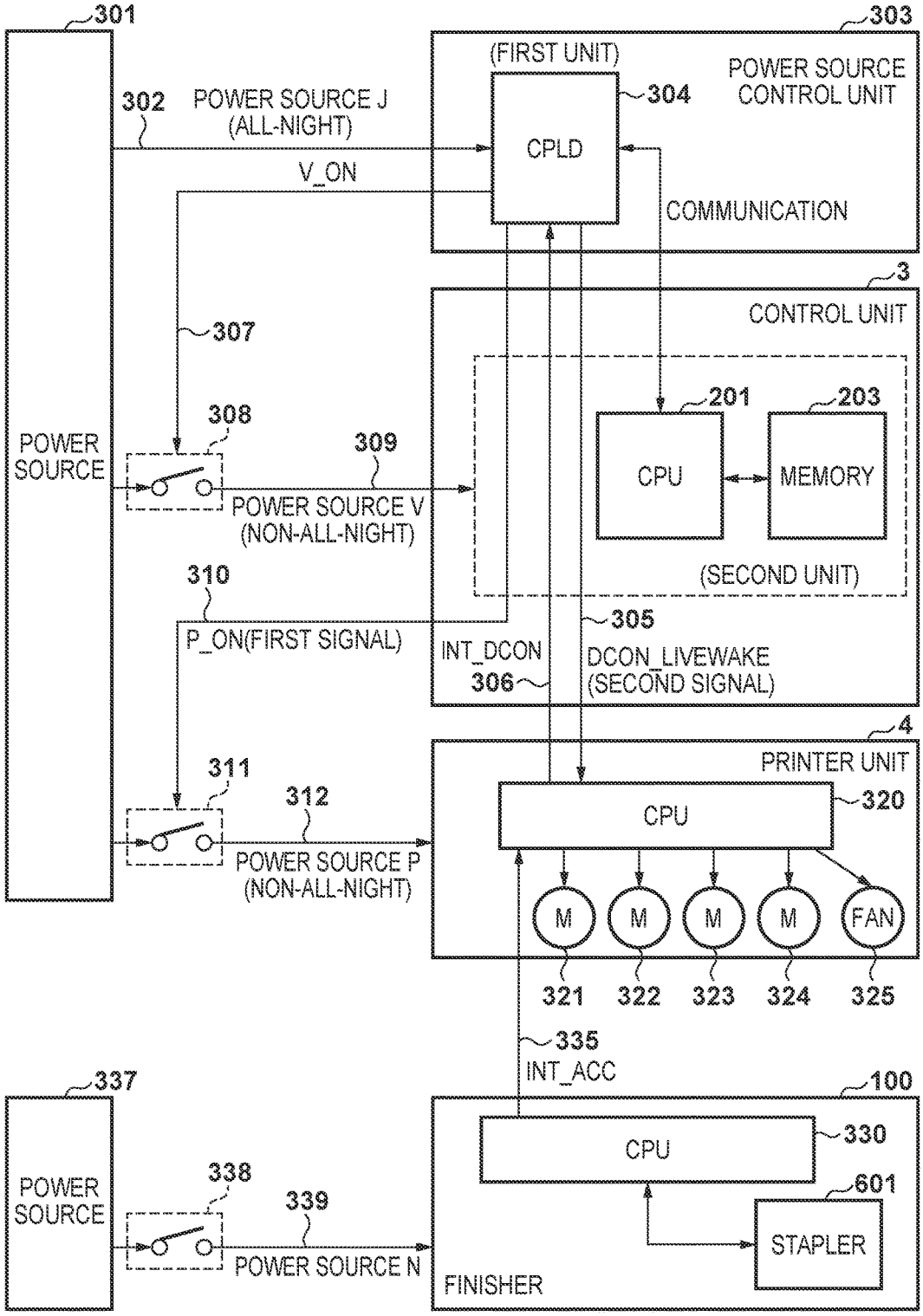
FIG. 15 is a block diagram for describing a power source system of an image forming apparatus according to a seventh embodiment.

FIG. 15 is a block diagram for describing a power source system of an image forming apparatus 1 according to the seventh embodiment. Note that the same parts as those of FIG. 6 are indicated by the same reference characters and will not be described.

In FIG. 15, when a power source switch 338 of the finisher 100 is turned on, power is supplied from a power source 337 through a power source line 339 to the finisher 100. Here, unlike the first embodiment, power is not supplied from the power source 301 to the finisher 100.

Figure 16:
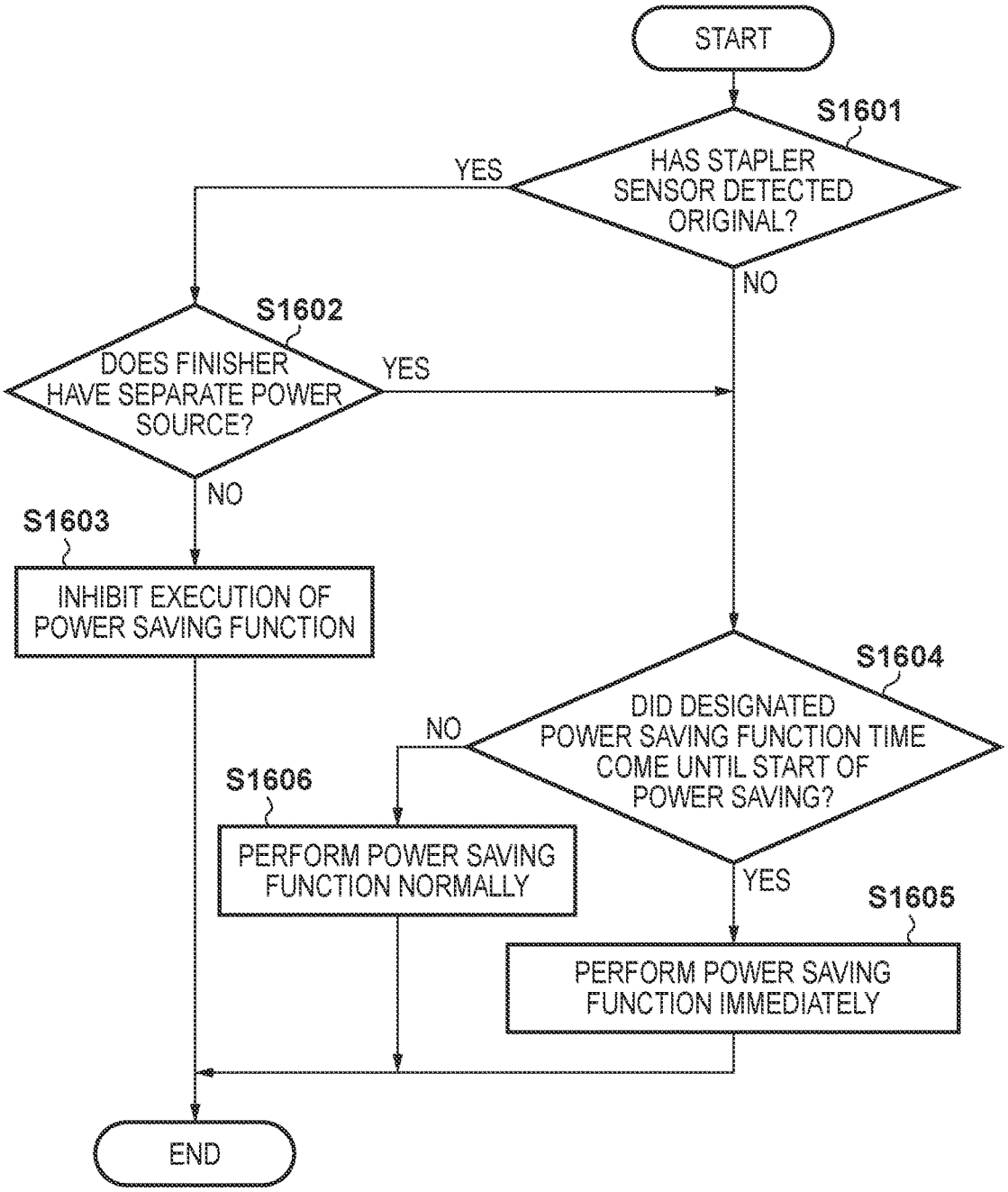
FIG. 16 is a flowchart for describing a process of the image forming apparatus of the seventh embodiment.

FIG. 16 is a flowchart for describing a process of the image forming apparatus 1 of the seventh embodiment. Note that the image forming apparatus 1 of the seventh embodiment has a configuration similar to that of the first embodiment, which will not be described.

This process is started when the original detection sensor of the driver portion 821 and staple driving unit 822 detects that the user has inserted an original into the original insertion slot of the stapler 601 of the finisher 100, and the CPU 201 receives a notification from the sensor. Initially, in step S1601, the CPU 201 determines whether or not an original is present in the original insertion slot of the stapler 601 of the finisher 100. If the determination result is positive, control proceeds to step S1602, in which the CPU 201 determines whether or not the finisher 100 has a separate power source, by inquiring of the finisher 100. Specifically, the CPU 201 communicates with the CPU 221 of the sub-board 220 through the bus controllers 204 and 224. The CPU 201 also communicates with the CPU 330 of the finisher 100 through the image processor 227, the device controller 226, and the CPU 320 of the printer unit 4. Thereafter, the CPU 201 inquires whether or not the power source switch 338 is present in the finisher 100, and receives the response, to determine whether or not the finisher 100 has a separate power source. If, in step S1602, the CPU 201 determines that the finisher 100 does not have a separate power source, control proceeds to step S1603, in which the CPU 201 inhibits the execution of the power saving function, and ends the process. In this case, timers and the like for the power saving function are not stopped.

On the other hand, if, in step S1601, the CPU 201 determines that an original is not present, or if, in step S1602, the CPU 201 determines that the finisher 100 has a separate power source, control proceeds to step S1604, in which the CPU 201 performs a process similar to that of step S1112 of FIG. 11B or the like. Specifically, the CPU 201 determines whether or not the power saving function timer has expired or the designated time of the power saving function has come from the time of inhibition of the execution of the power saving function until the time of the start of the power saving function. If the determination result is positive, control proceeds to step S1605. In step S1605, the CPU 201 immediately performs the power saving function, and ends the process. Otherwise, control proceeds to step S1606, in which the CPU 201 normally performs the power saving function, and ends the process.

As described above, according to the seventh embodiment, if the image forming apparatus 1 and the finisher 100 have different power sources, then even when the image forming apparatus 1 shifts to the sleep state, the finisher is not influenced, and therefore, the image forming apparatus 1 can immediately perform the power saving function.

Other Embodiments

In the above embodiments, if a condition for shifting to the power saving state is satisfied (S1003: Yes), the power saving function is performed. When the power saving function is performed, then if the sensor of the stapler has detected an original, the execution of the power saving function is inhibited, for example. However, in the above embodiments, a condition for shifting to the power saving state may be that the sensor of the stapler has not detected an original. Specifically, in step S1003, if the sensor of the stapler has not detected an original (S1003: No), the process of step S1004 may be performed.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-096220, filed May 7, 2014, which is hereby incorporated by reference herein in its entirety.

What is claimed is:

1. An image forming system comprising: an image forming apparatus that has a display, and a printing unit configured to form an image on a sheet; and a staple apparatus that has a staple unit configured to staple a sheet, the image forming system being capable of performing a first staple mode for performing, as a series of operations, image formation on a sheet by the printing unit and stapling by the staple unit, and a second staple mode for stapling a sheet by the staple unit without driving the printing unit, and comprising:

a placement portion which is provided in the staple apparatus, and in which a sheet to be stapled in the second staple mode is placed;

a sensor configured to detect a sheet in the placement portion; and a controller configured to turn on the display in a case where a sheet is detected by the sensor in a state of the display being off.

2. The image forming system according to claim 1, wherein in a case where a sheet is detected by the sensor, the display displays a message for asking a user to remove the sheet from the placement portion.

3. The image forming system according to claim 1, wherein the controller turns off the display at least based on the sensor not detecting a sheet.

4. The image forming system according to claim 1, wherein a sheet to be stapled in the second staple mode is a sheet placed by a user in the placement portion.

5. The image forming system according to claim 1, wherein the placement portion has a slot through which a user can insert a sheet in the placement portion.

6. An image forming apparatus that has a display, and a printing unit configured to form an image on a sheet, and that conveys a sheet to be stapled by a staple apparatus, wherein the staple apparatus is capable of performing a first staple mode for performing, as a series of operations, image formation on a sheet by the printing unit and stapling, and a second staple mode for stapling a sheet without driving the printing unit, and comprises a placement portion in which a sheet to be stapled in the second staple mode is placed, and a sensor configured to detect a sheet in the placement portion, the image forming apparatus comprising:

a controller configured to turn on the display in a case where a sheet is detected by the sensor in a state of the display being off.

7. The image forming apparatus according to claim 6, wherein in a case where a sheet is detected by the sensor, the display displays a message for asking a user to remove the sheet from the placement portion.

8. The image forming apparatus according to claim 6, wherein the controller turns off the display at least based on the sensor not detecting a sheet.

9. The image forming apparatus according to claim 6, wherein a sheet to be stapled in the second staple mode is a sheet placed by a user in the placement portion.

10. The image forming apparatus according to claim 6, wherein the placement portion has a slot through which a user can insert a sheet in the placement portion.

11. An image forming apparatus being capable of conveying a sheet to be stapled by a staple apparatus, the staple apparatus being also capable of stapling a sheet inserted by a user in a sheet insertion portion of the staple apparatus, the image forming apparatus comprising:

a printing unit configured to form an image on a sheet; and a display configured to display a message for asking a user to pull out a sheet inserted in the sheet insertion portion.

12. The image forming apparatus according to claim 11, wherein the staple apparatus comprises a sensor configured to detect that a sheet has been inserted in the sheet insertion portion, wherein the display displays the message in a case where it is detected by the sensor that a sheet has been inserted in the sheet insertion portion.

13. The image forming apparatus according to claim 12, wherein the display does not display the message in a case where it is not detected by the sensor that a sheet has been inserted in the sheet insertion portion.

14. The image forming apparatus according to claim 12, further comprising a controller configured to turn off the display at least based on the sensor not detecting a sheet, and to turn on the display based on the sensor detecting a sheet in a state where the display is off.

15. The image forming apparatus according to claim 11, wherein the sheet insertion portion has a slot through which a user can insert a sheet in the sheet insertion portion.

16. The image forming apparatus according to claim 11, wherein the staple apparatus staples a sheet on which an image is formed by the printing unit and which is conveyed from the printing unit.

17. An image forming apparatus being capable of conveying a sheet to be stapled by a staple apparatus, the staple apparatus being also capable of stapling a sheet inserted by a user in a sheet insertion portion of the staple apparatus, the image forming apparatus comprising:

a printing unit configured to form an image on a sheet; and a display configured to display a message for notifying a user that a sheet has been inserted in the sheet insertion portion.

18. The image forming apparatus according to claim 17, wherein the staple apparatus comprises a sensor configured to detect that a sheet has been inserted in the sheet insertion portion, wherein the display displays the message in a case where it is detected by the sensor that a sheet has been inserted in the sheet insertion portion.

19. The image forming apparatus according to claim 18, wherein the display does not display the message in a case where it is not detected by the sensor that a sheet has been inserted in the sheet insertion portion.

20. The image forming apparatus according to claim 18, further comprising a controller configured to turn off the display at least based on the sensor not detecting a sheet, and to turn on the display based on the sensor detecting a sheet in a state where the display is off.

21. The image forming apparatus according to claim 17, wherein the sheet insertion portion has a slot through which a user can insert a sheet in the sheet insertion portion.

22. The image forming apparatus according to claim 17, wherein the staple apparatus staples a sheet on which an image is formed by the printing unit and which is conveyed from the printing unit.

* * * * *